US009377726B2

(12) United States Patent
Suzuki et al.

(10) Patent No.: US 9,377,726 B2
(45) Date of Patent: Jun. 28, 2016

(54) FIXING DEVICE

(71) Applicant: Brother Kogyo Kabushiki Kaisha, Nagoya-shi, Aichi-ken (JP)

(72) Inventors: Noboru Suzuki, Komaki (JP); Kei Ishida, Nagoya (JP); Takuji Matsuno, Ichinomiya (JP); Yoshihiro Miyauchi, Ama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/697,330

(22) Filed: Apr. 27, 2015

(65) Prior Publication Data

US 2015/0227092 A1 Aug. 13, 2015

Related U.S. Application Data

(63) Continuation of application No. 13/623,145, filed on Sep. 20, 2012, now Pat. No. 9,020,408.

(30) Foreign Application Priority Data

Sep. 20, 2011 (JP) ..... 2011-205116

(51) Int. Cl.
*G03G 15/20* (2006.01)

(52) U.S. Cl.
CPC ..... *G03G 15/2028* (2013.01); *G03G 15/2053* (2013.01); *G03G 15/2064* (2013.01); *G03G 15/2089* (2013.01); *G03G 2215/2016* (2013.01);

(Continued)

(58) Field of Classification Search
CPC ..... G03G 15/20
USPC ..... 399/329
See application file for complete search history.

(56) References Cited

U.S. PATENT DOCUMENTS 6,101,362 A 8/2000 Shimura et al.
6,944,420 B2 9/2005 Kanamori et al.

(Continued)

FOREIGN PATENT DOCUMENTS

JP H07-191561 A 7/1995
JP H08-234521 A 9/1996

(Continued)

OTHER PUBLICATIONS

Jun. 16, 2015—(JP) Notification of Reasons for Refusal—App 2011-205116.

*Primary Examiner* — Clayton E LaBalle
*Assistant Examiner* — Kevin Butler
(74) *Attorney, Agent, or Firm* — Banner & Witcoff, Ltd.

(57) ABSTRACT

A fixing device configured to heat-fix a developer image on a recording sheet, the fixing device includes: a flexible cylindrical member; a nip member configured to slidingly contact an inner peripheral surface of the cylindrical member; a heating member that is arranged at an inside of the cylindrical member and is configured to heat the nip member; a stay configured to support the nip member with surrounding the heating member; a backup member configured to interpose the cylindrical member between the nip member and the backup member; a cover member that is arranged at the inside of the cylindrical member and is configured to cover the stay from an opposite side to the heating member; and a first support member configured to support the cover member and form a gap between the stay and the cover member.

23 Claims, 13 Drawing Sheets

(52) U.S. Cl.
CPC ..... *G03G 2215/2032* (2013.01); *G03G 2215/2035* (2013.01)

(56) References Cited

U.S. PATENT DOCUMENTS

| | | | | |
|---|---|---|---|---|
| 7,242,895 | B2 | 7/2007 | Inada et al. | |
| 7,792,476 | B2 | 9/2010 | Seol et al. | |
| 8,412,083 | B2 | 4/2013 | Fujiwara et al. | |
| 8,412,084 | B2 | 4/2013 | Ishida et al. | |
| 8,452,218 | B2 | 5/2013 | Fujiwara et al. | |
| 8,472,835 | B2 | 6/2013 | Suzuki et al. | |
| 8,489,007 | B2 | 7/2013 | Fujiwara et al. | |
| 8,494,424 | B2 | 7/2013 | Ishida et al. | |
| 8,509,667 | B2 | 8/2013 | Miyauchi | |
| 8,515,325 | B2 | 8/2013 | Miyauchi et al. | |
| 8,559,862 | B2 | 10/2013 | Kondo et al. | |
| 8,660,445 | B2 | 2/2014 | Ishida et al. | |
| 8,676,102 | B2 | 3/2014 | Hiramatsu | |
| 8,750,775 | B2 | 6/2014 | Ishida et al. | |
| 2001/0022909 | A1* | 9/2001 | Takeuchi | G03G 9/08797 399/328 |
| 2007/0065191 | A1 | 3/2007 | Iwasaki et al. | |
| 2009/0208264 | A1 | 8/2009 | Fujiwara et al. | |
| 2009/0257794 | A1 | 10/2009 | Kaino et al. | |
| 2011/0058862 | A1* | 3/2011 | Yamaguchi | G03G 15/2039 399/329 |
| 2011/0150544 | A1 | 6/2011 | Ishida et al. | |
| 2011/0158715 | A1 | 6/2011 | Suzuki et al. | |
| 2011/0158716 | A1 | 6/2011 | Fujiwara et al. | |
| 2011/0158717 | A1 | 6/2011 | Suzuki et al. | |
| 2011/0158718 | A1 | 6/2011 | Fujiwara et al. | |
| 2011/0158719 | A1 | 6/2011 | Miyauchi et al. | |
| 2011/0158720 | A1 | 6/2011 | Lee | |
| 2011/0164906 | A1 | 7/2011 | Ishida et al. | |
| 2011/0206406 | A1 | 8/2011 | Suzuki et al. | |
| 2011/0206409 | A1 | 8/2011 | Kondo et al. | |
| 2011/0211882 | A1 | 9/2011 | Suzuki et al. | |
| 2011/0229225 | A1 | 9/2011 | Ishii et al. | |
| 2011/0236088 | A1 | 9/2011 | Maruyama | |
| 2011/0318074 | A1 | 12/2011 | Hiramatsu | |
| 2012/0051809 | A1 | 3/2012 | Miyauchi | |
| 2012/0121303 | A1* | 5/2012 | Takagi | G03G 15/2053 399/329 |
| 2012/0121305 | A1* | 5/2012 | Yoshikawa | G03G 15/2053 399/329 |
| 2012/0155935 | A1* | 6/2012 | Yoshikawa | G03G 15/2053 399/329 |
| 2012/0163883 | A1 | 6/2012 | Tsukawaki | |
| 2012/0163884 | A1 | 6/2012 | Kondo et al. | |
| 2012/0163885 | A1* | 6/2012 | Ishida | G03G 15/2053 399/329 |
| 2012/0163886 | A1 | 6/2012 | Suzuki | |
| 2012/0251138 | A1* | 10/2012 | Ishida | G03G 15/2053 399/33 |
| 2012/0251207 | A1* | 10/2012 | Ishida | G03G 15/2053 399/329 |
| 2012/0275830 | A1* | 11/2012 | Suzuki | G03G 15/2053 399/329 |
| 2012/0275831 | A1 | 11/2012 | Ishida et al. | |
| 2012/0275832 | A1* | 11/2012 | Suzuki | G03G 15/2025 399/329 |
| 2012/0275833 | A1* | 11/2012 | Ishida | G03G 15/2053 399/329 |
| 2012/0308276 | A1* | 12/2012 | Miyauchi | G03G 15/2017 399/329 |
| 2012/0308277 | A1* | 12/2012 | Suzuki | G03G 15/2085 399/329 |
| 2013/0071155 | A1* | 3/2013 | Suzuki | G03G 15/2064 399/329 |
| 2013/0071156 | A1* | 3/2013 | Suzuki | G03G 15/2053 399/329 |
| 2013/0071157 | A1* | 3/2013 | Suzuki | G03G 15/2053 399/329 |
| 2013/0071158 | A1* | 3/2013 | Suzuki | G03G 15/2053 399/329 |
| 2013/0071159 | A1* | 3/2013 | Suzuki | G03G 15/2053 399/329 |
| 2013/0084111 | A1* | 4/2013 | Iwata | G03G 15/2053 399/329 |
| 2013/0136511 | A1* | 5/2013 | Suzuki | G03G 15/2035 399/329 |
| 2013/0136512 | A1* | 5/2013 | Suzuki | G03G 15/2053 399/329 |
| 2013/0136513 | A1* | 5/2013 | Suzuki | G03G 15/2053 399/329 |
| 2013/0136514 | A1* | 5/2013 | Suzuki | G03G 15/2053 399/329 |
| 2013/0195527 | A1 | 8/2013 | Suzuki et al. | |
| 2013/0287459 | A1 | 10/2013 | Ishida et al. | |
| 2013/0322937 | A1* | 12/2013 | Suzuki | G03G 15/2003 399/329 |
| 2014/0086648 | A1* | 3/2014 | Maruyama | G03G 15/2053 399/329 |
| 2014/0086649 | A1* | 3/2014 | Hazeyama | G03G 15/2053 399/329 |
| 2014/0186074 | A1* | 7/2014 | Ishida | G03G 15/2032 399/122 |
| 2015/0093166 | A1* | 4/2015 | Ishida | G03G 15/2064 399/329 |
| 2015/0093168 | A1* | 4/2015 | Hiramatsu | G03G 15/2053 399/329 |

FOREIGN PATENT DOCUMENTS

| | | | | |
|---|---|---|---|---|
| JP | H08-248791 | A | 9/1996 | |
| JP | 2008-224878 | A | 9/2008 | |
| JP | 2008224878 | * | 9/2008 | G03G 15/20 |
| JP | 2008233886 | A | 10/2008 | |
| JP | 2011-113015 | A | 6/2011 | |

* cited by examiner

FIXING DEVICE

CROSS-REFERENCE TO RELATED APPLICATIONS

This application is a continuation of U.S. patent application Ser. No. 13/623,145, filed Sep. 20, 2012, which claims priority from Japanese Patent Application No. 2011-205116 filed on Sep. 20, 2011, the entire subject matter of which is incorporated herein by reference.

TECHNICAL FIELD

The invention relates to a fixing device that heat-fixes a toner image on a recording sheet.

BACKGROUND

There have been known a fixing device which includes a cylindrical fixing film, a nip plate slidingly contacting an inner peripheral surface of the fixing film, a pressing roller having the fixing film interposed between the nip plate and the pressing roller, a heater disposed at an inside of the fixing film, a stay supporting the nip plate with surrounding the heater and a guide rib provided to the stay and guiding the inner peripheral surface of the fixing film. In this related-art, a nip portion formed between the nip plate and the pressing roller is heated by the heater, so that a toner image is heat-fixed on a sheet when the sheet passes through the nip portion.

SUMMARY

Therefore, illustrative aspects of the invention provide a fixing device capable of efficiently heating a nip member.

According to one illustrative aspect of the invention, there is provided a fixing device configured to heat-fix a developer image on a recording sheet, the fixing device comprising: a flexible cylindrical member; a nip member configured to slidingly contact an inner peripheral surface of the cylindrical member; a heating member that is arranged at an inside of the cylindrical member and is configured to heat the nip member; a stay configured to support the nip member with surrounding the heating member; a backup member configured to interpose the cylindrical member between the nip member and the backup member; a cover member that is arranged at the inside of the cylindrical member and is configured to cover the stay from an opposite side to the heating member; and a first support member configured to support the cover member and form a gap between the stay and the cover member.

DETAILED DESCRIPTION

<General Overview>

Figure 1:
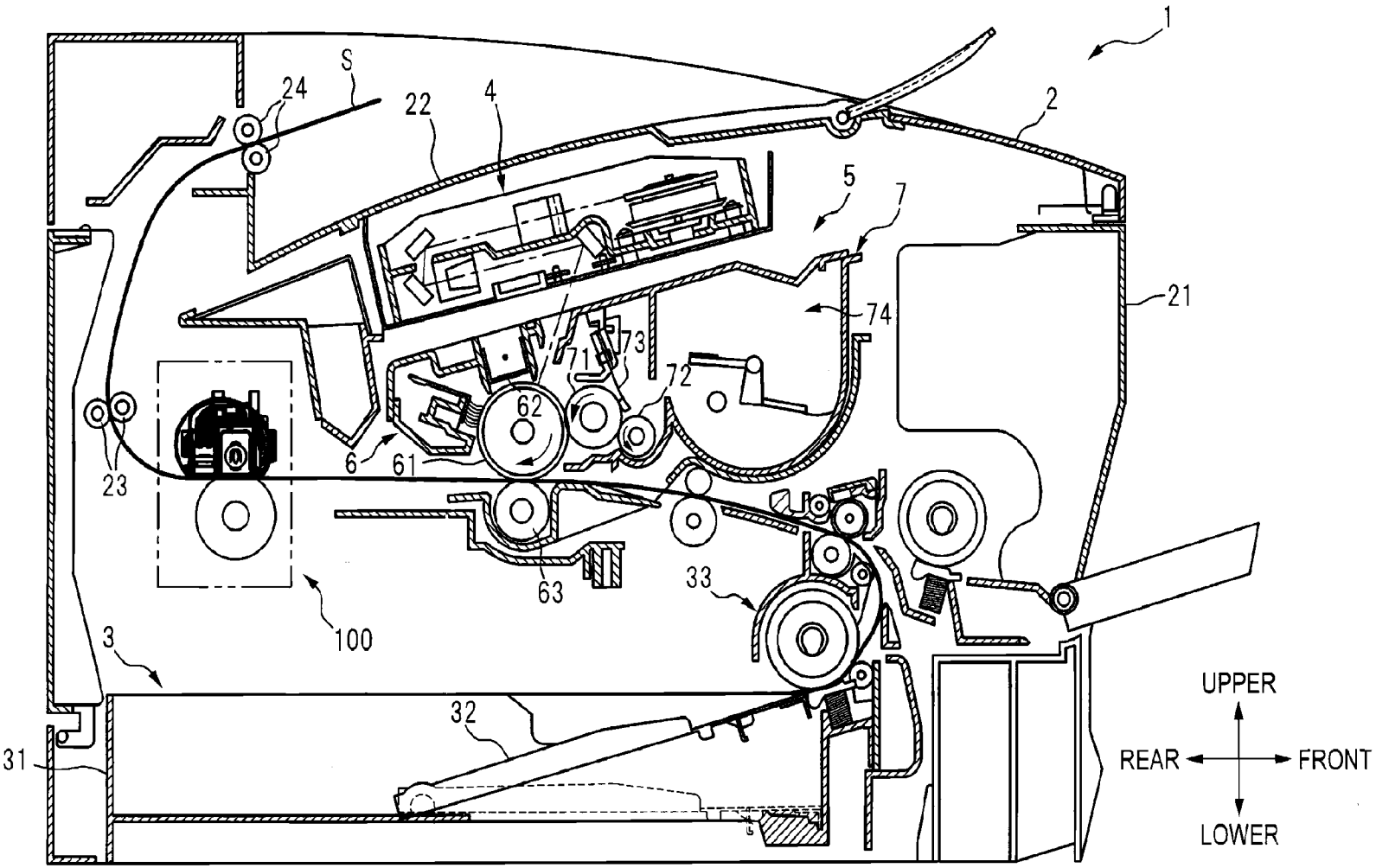
FIG. 1 shows a schematic configuration of an image forming apparatus including a fixing device according to an exemplary embodiment of the invention.

In the above-described related art, the heat of the nip plate escapes to the outside via the stay and the rib, so that the nip plate may not be efficiently heated.

Therefore, illustrative aspects of the invention provide a fixing device capable of efficiently heating a nip member (e.g., nip plate).

According to one illustrative aspect of the invention, there is provided a fixing device configured to heat-fix a developer image on a recording sheet, the fixing device comprising: a flexible cylindrical member; a nip member configured to slidingly contact an inner peripheral surface of the cylindrical member; a heating member that is arranged at an inside of the cylindrical member and is configured to heat the nip member; a stay configured to support the nip member with surrounding the heating member; a backup member configured to interpose the cylindrical member between the nip member and the backup member; a cover member that is arranged at the inside of the cylindrical member and is configured to cover the stay from an opposite side to the heating member; and a first support member configured to support the cover member and form a gap between the stay and the cover member.

According thereto, a gap between the stay and the cover member configures a thermal insulating layer. Thus, it is possible to suppress the heat from escaping from the stay to the outside, thereby efficiently heating the nip member.

According to another illustrative aspect of the invention, the first support member is a spacer member provided between the stay and the cover member.

According to still another illustrative aspect of the invention, the cover member is made of resin.

According thereto, the cover member is made of resin, so that the thermal insulting properties of the cover member are improved. Therefore, it is possible to suppress the heat in a space between the stay and the cover member from escaping to the outside of the cover member and to thus suppress the temperature of the space from being lowered. As a result, it is possible to further suppress the heat from escaping from the stay to the space.

According to still another illustrative aspect of the invention, the stay is made of metal.

According to still another illustrative aspect of the invention, the heating member is a halogen lamp.

According to still another illustrative aspect of the invention, a reflection member that reflects heat from the halogen lamp toward the nip member is provided between the stay and the halogen lamp.

According thereto, it is possible to heat the nip member more efficiently.

According to still another illustrative aspect of the invention, the spacer member is integrally formed with the cover member by resin.

According thereto, it is possible to reduce the number of parts, compared to a configuration where the space member and the cover member are separately provided.

According to still another illustrative aspect of the invention, the cover member comprises: a first cover member configured to cover the stay; a second cover member configured to cover the first cover member from an opposite side to the stay; and a second support member configured to support the second cover member and form a gap between the second cover member and the first cover member.

According thereto, the air layer for thermal insulation is configured with two layers. Therefore, it is possible to further suppress the heat from escaping from the stay to the outside, thereby heating the nip member more efficiently.

According to still another illustrative aspect of the invention, the nip member comprises an extension that more extends toward a downstream side of a conveyance direction of the recording sheet than a nip portion between the nip member and the backup member, and the cover member includes an extension-side guide part that is positioned at the heating member-side in a direction that the nip member and the backup member face each other with respect to the extension and is configured to guide an inner peripheral surface of the cylindrical member.

According thereto, it is possible to suppress the cylindrical member from being largely bent at a leading end of the extension of the nip member or at a member adjacent to the leading end by the extension-side guide part of the cover member. Thus, it is possible to suppress the deterioration of the cylindrical member.

According to still another illustrative aspect of the invention, a plurality of the spacer members is provided at an interval in a width direction of the recording sheet.

According thereto, it is possible to suppress the cover member from rattling relative to the stay.

According to still another illustrative aspect of the invention, the spacer member includes a positioning protrusion that protrudes from the spacer member toward the stay, and the stay includes a positioning hole into which the positioning protrusion is configured to be engaged.

According thereto, it is possible to lower a height of the positioning protrusion as the spacer member, compared to a structure where the positioning protrusion protrudes from the cover member. Thus, it is possible to increase the rigidity of the positioning protrusion.

According to still another illustrative aspect of the invention, the first cover member and the second cover member are fastened by a screw.

According thereto, since the gap between the stay and the cover member configures a thermal insulating layer, it is possible to efficiently heat the nip member.

<Exemplary Embodiments>

Hereinafter, exemplary embodiments of the invention will be specifically described with reference to the drawings. In the below descriptions, a schematic configuration of an image forming apparatus 1 including a fixing device 100 according to an exemplary embodiment of the invention will be briefly described, and then a specific configuration of the fixing device 100 will be described. Incidentally, a laser printer is one example of the image forming apparatus 1.

Also, in the below descriptions, the directions are described on the basis of a user who uses the image forming apparatus 1. That is, the right side of FIG. 1 is referred to as the 'front', the left side is referred to as the 'rear', the front side is referred to as the 'left' and the inner side is referred to as the 'right.' Also, the upper-lower direction of FIG. 1 is referred to as the 'upper-lower.'

(Schematic Configuration of Image Forming Apparatus)

As shown in FIG. 1, the image forming apparatus 1 includes, in a body housing 2, a feeder unit 3 that feeds a sheet S, which is one example of a recording medium, an exposure device 4, a process cartridge 5 that transfers a toner image (which is one example of a developer image) on the sheet S and a fixing device 100 that heat-fixes the toner image transferred on the sheet S.

The feeder unit 3 is provided at a lower part in the body housing 2. The feeder unit 3 includes a sheet feeding tray 31, a sheet pressing plate 32 and a sheet feeding mechanism 33. The sheet S accommodated in the sheet feeding tray 31 is upwardly inclined by the sheet pressing plate 32 and is fed toward the process cartridge 5 (e.g., between a photosensitive drum 61 and a transfer roller 63) by the sheet feeding mechanism 33.

The exposure device 4 is arranged at an upper part in the body housing 2. The exposure device 4 includes a laser emitting unit (not shown), a polygon mirror, a lens, a reflector and the like whose reference numerals are omitted. In the exposure device 4, a laser light (refer to the dotted-dashed line) based on image data, which is emitted from the laser emitting unit, is scanned on a surface of the photosensitive drum 61 at high speed, thereby exposing the surface of the photosensitive drum 61.

The process cartridge 5 is disposed below the exposure device 4. The process cartridge 5 is configured to be detachably mounted to the body housing 2 through an opening that is formed when a front cover 21 provided to the body housing 2 is opened. The process cartridge 5 includes a drum unit 6 and a developing unit 7.

The drum unit 6 includes the photosensitive drum 61, a charger 62 and the transfer roller 63. Also, the developing unit 7 is configured to be detachably mounted to the drum unit 6. The developing unit 7 includes a developing roller 71, a supply roller 72, a layer thickness regulation blade 73 and a toner accommodation unit 74 that accommodates toner (developer).

In the process cartridge 5, the surface of the photosensitive drum 61 is uniformly charged by the charger 62 and then exposed by the high-speed scanning of the laser light emitted from the exposure device 4, so that an electrostatic latent image based on image data is formed on the photosensitive drum 61. Also, the toner in the toner accommodation unit 74 is supplied to the developing roller 71 via the supply roller 72, is introduced between the developing roller 71 and the layer thickness regulation blade 73, and is carried on the developing roller 71 as a thin layer having a predetermined thickness.

The toner carried on the developing roller 71 is supplied from the developing roller 71 to the electrostatic latent image formed on the photosensitive drum 61. Thereby, the electrostatic latent image becomes visible, and a toner image is thus formed on the photosensitive drum 61. Then, the sheet S is conveyed between the photosensitive drum 61 and the transfer roller 63, so that the toner image on the photosensitive drum 61 is transferred onto the sheet S.

The fixing device 100 is arranged at the rear of the process cartridge 5. The toner image transferred on the sheet S passes through the fixing device 100, so that the toner image is heat-fixed on the sheet S. The sheet S having the toner image heat-fixed thereon is discharged on a sheet discharge tray 22 by conveyance rollers 23, 24.

(Detailed Configuration of Fixing Device)

Figure 2:
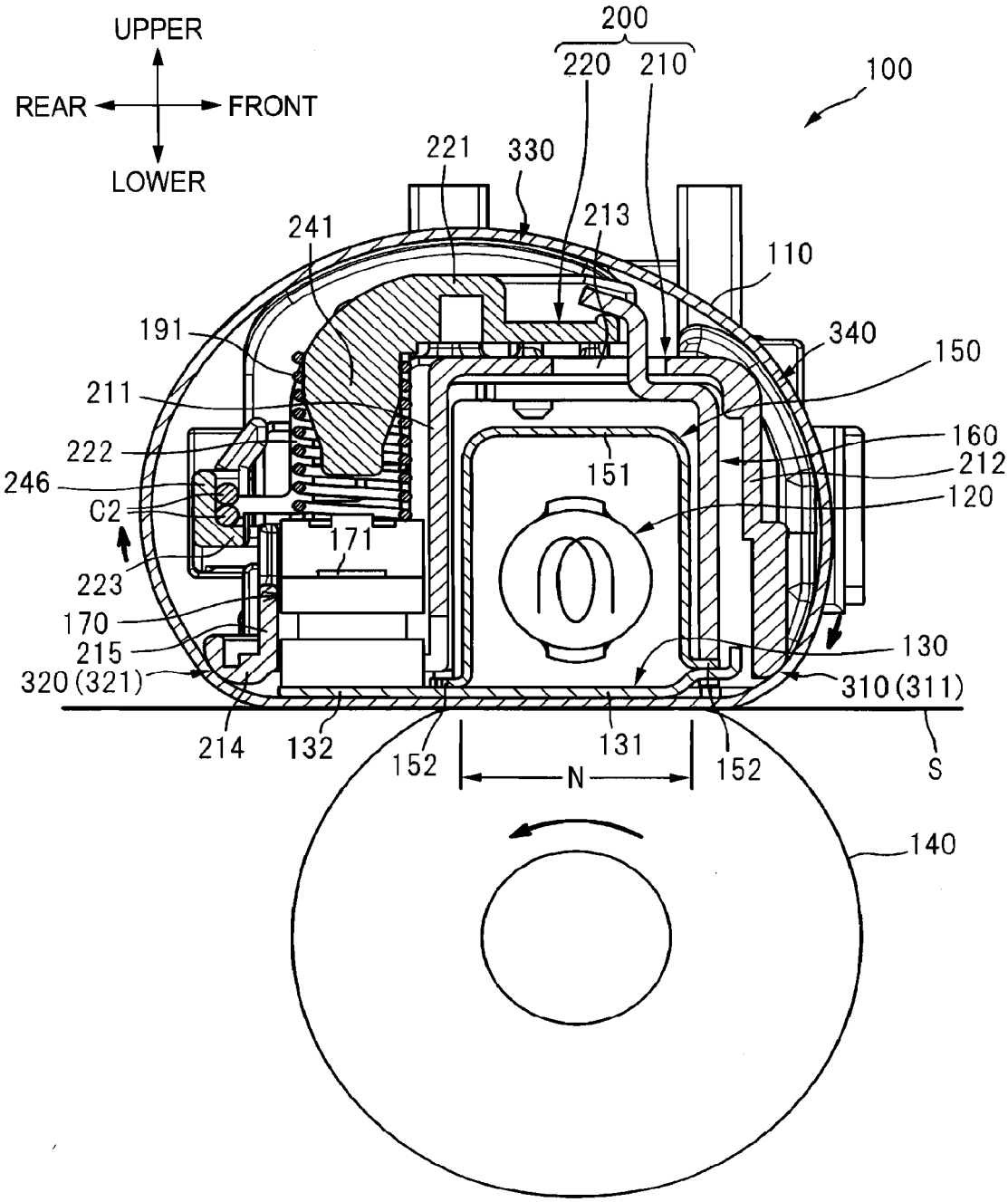
FIG. 2 is a sectional view showing a vicinity of a thermostat of the fixing device.

As shown in FIG. 2, the fixing device 100 includes a fixing belt 110 that is one example of the cylindrical member, a halogen lamp 120 that is one example of the heating member, a nip plate 130 that is one example of a nip member, a pressing roller 140 that is one example of a backup member, a reflection member 150, a stay 160, a thermostat 170, two thermistors 180 (refer to FIGS. 3 and 4), cables C1, C2 (refer to FIG. 5) and a cover member 200.

The fixing belt 110 is a belt of an endless shape (cylindrical shape) having heat resistance and flexibility. A rotation of the fixing belt 110 is guided by a guide part (e.g., a nip upstream guide 310, nip downstream guides 320, upper guides 330 and a front part guide 340) that is formed at the cover member 200, which will be described later. In this exemplary embodiment, the fixing belt 110 is made of metal, for example stainless steel, nickel and the like.

The halogen lamp 120 is a member that generates radiation heat to thus heat the nip plate 130 and the fixing belt 110 (e.g., nip portion N), thereby heating the toner on the sheet S. The halogen lamp 120 is arranged at the inside of the fixing belt 110 at a predetermined interval from inner surfaces of the fixing belt 110 and the nip plate 130.

Figure 3:
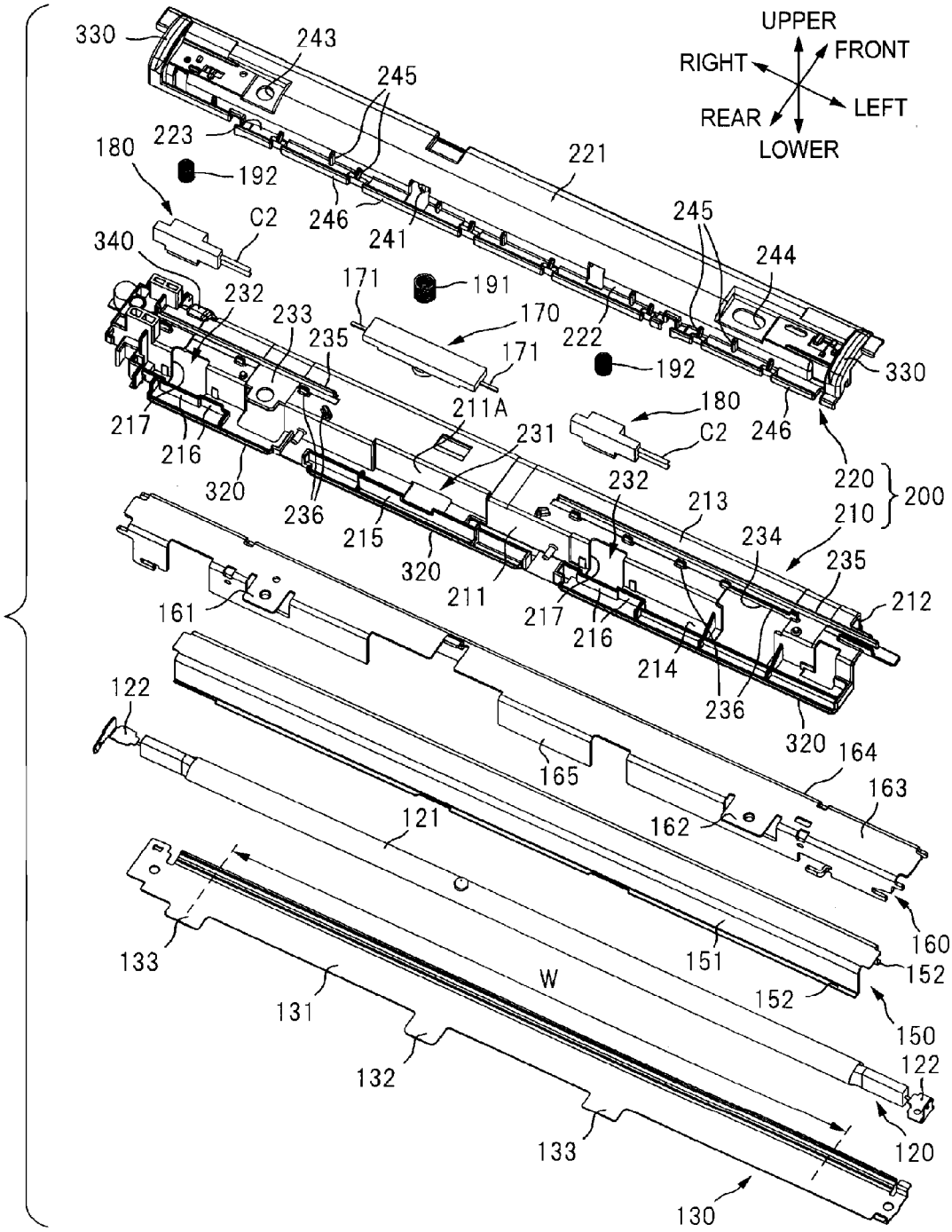
FIG. 3 is a perspective view of a nip plate, a halogen lamp, a reflection member, a stay, a first cover member, a thermostat, thermistors and a second cover member.

As shown in FIG. 3, the halogen lamp 120 is formed by arranging a filament (not shown) in an elongated cylindrical glass tube 121, closing both longitudinal end portions of the glass tube 121 and enclosing inert gases including halogen element in the glass tube. A pair of electrodes 122 electrically connected to end portions of the filament in the glass tube 121 is provided on both longitudinal end portions of the halogen lamp 120.

Again referring to FIG. 2, the nip plate 130 is a plate-shaped member to which the radiation heat from the halogen lamp 120 is applied. A lower surface of the nip plate 130 is arranged to slidingly contact an inner peripheral surface of the fixing belt 110. In this exemplary embodiment, the nip plate 130 is made of metal, and for example is formed by bending an aluminum plate and the like having thermal conductivity higher than the stay 160 made of steel.

As shown in FIG. 3, the nip plate 130 includes a base part 131, a first extension 132 and second extensions 133. The base part 131 is a part that is configured to slidingly contact the inner peripheral surface of the fixing belt 110 and transfer the heat from the halogen lamp 120 to the toner on the sheet S through the fixing belt 110.

The first extension 132 and the second extension 133 have a flat plate shape, respectively. The first extension 132 and the second extension 133 are formed to protrude rearward from a rear end of the base part 131. In other words, the first extension 132 and the second extension 133 are formed to extend toward a more downstream side in a conveyance direction of the sheet S than the nip portion N.

One first extension 132 is formed near a center of the rear end of the base part 131 in the left-right direction, and the thermostat 170 is arranged to face an upper surface of the first extension. Also, the second extensions 133 are respectively formed near the center and near a right end of the rear end of the base part 131 in the left-right direction, and the thermistors 180 are arranged to face upper surfaces of the second extensions.

As shown in FIG. 2, the pressing roller 140 is a member forming the nip portion N between the fixing belt 110 and the pressing roller by interposing the fixing belt 110 between the nip plate 130 and the pressing roller. The pressing roller 140 is disposed below the nip plate 130. In this exemplary embodiment, in order to form the nip portion N, one of the nip plate 130 and the pressing roller 140 is urged toward the other.

The pressing roller 140 is configured to rotate as a driving force is transferred thereto from a motor (not shown) provided in the body housing 2. As the pressing roller rotates, it rotates the fixing belt 110 by a frictional force with the fixing belt 110 (or sheet S). As the sheet S having the toner image transferred thereto is conveyed between the pressing roller 140 and the heated fixing belt 110 (e.g., at the nip portion N), the toner image is heat-fixed.

The reflection member 150 is a member that reflects the radiation heat from the halogen lamp 120 toward the nip plate 130. The reflection member 150 is arranged at a predetermined interval from the halogen lamp 120 so that the reflection member surrounds (covers) the halogen lamp 120 at the inside of the fixing belt 110. Specifically, the reflection member 150 is arranged between the halogen lamp 120 and the stay 160. The reflection member 150 is provided as described above, so that the nip plate 130 can be efficiently heated.

The reflection member 150 is formed by bending an aluminum plate and the like having high reflectance of the infrared and far-infrared into a substantial U shape, when seen from the section. More specifically, the reflection member 150 includes a reflection part 151 having a bent shape and flange parts 152 extending from front and rear end portions of the reflection part 151 toward the outside in the front-rear direction.

The stay 160 is a member that supports the front and rear end portions of the nip plate 130 (e.g., base part 131) via the reflection member 150 (e.g., flange parts 152) to thus bear load applied from the pressing roller 140. The stay 160 is arranged to cover the halogen lamp 120 and the reflection member 150 at the inside of the fixing belt 110. Incidentally, in the configuration in which the nip plate 130 urges the pressing roller 140, the load means a reactive force of the force with which the nip plate 130 urges the pressing roller 140.

The stay 160 is formed by bending, for example, a steel plate having relatively high rigidity into a substantial U shape, when seen from the section, conforming to an outer surface shape of the reflection member 150 (reflection part 151). Incidentally, a part of the metal stay 160 and the reflection member 150 contacting the nip plate 130 is formed to have a partially tooth-missing structure, so that a contact area with the nip plate 130 is reduced. Thereby, the rigidity and the heating efficiency can be improved.

As shown in FIG. 3, the stay 160 has a substantial U shape, when seen from the section thereof, by an upper wall part 163, a front wall part 164 extending downward from a front end of the upper wall part 163 and a rear wall part 165 extending downward from a rear end of the upper wall part 163. A right fixation part 161 is provided at the right side of the upper wall part 163, and a left fixation part 162 is provided at the left side. The right fixation part 161 and the left fixation part 162 are formed to extend rearward from the upper wall part 163 and have a penetrated screw hole (reference numeral thereof is omitted), respectively.

As shown in FIG. 2, the thermostat 170 is a member that has a bimetal and the like (not shown) and is configured to cut off the power feeding when detecting a predetermined temperature. The thermostat 170 is arranged at an opposite side (e.g., outside of the stay 160) to the halogen lamp 120 with the reflection member 150 and the stay 160 being interposed therebetween at the inside of the fixing belt 110.

More specifically, the thermostat 170 has a lower surface that is a temperature detection surface and is arranged to face an upper surface of the first extension 132 (e.g., an opposite surface to the pressing roller 140). The first extension 132 is a part that directly extends from the base part 131 interposing the fixing belt 110 (and sheet S) between the base part and the pressing roller 140. Hence, the thermostat 170 is arranged to face the first extension 132, so that it is possible to detect a temperature near the nip portion N with good precision.

The thermostat 170 includes, at its both end surfaces, electrodes 171 having a plate shape protruding toward the outside in the left-right direction (refer to FIG. 3).

Figure 4:
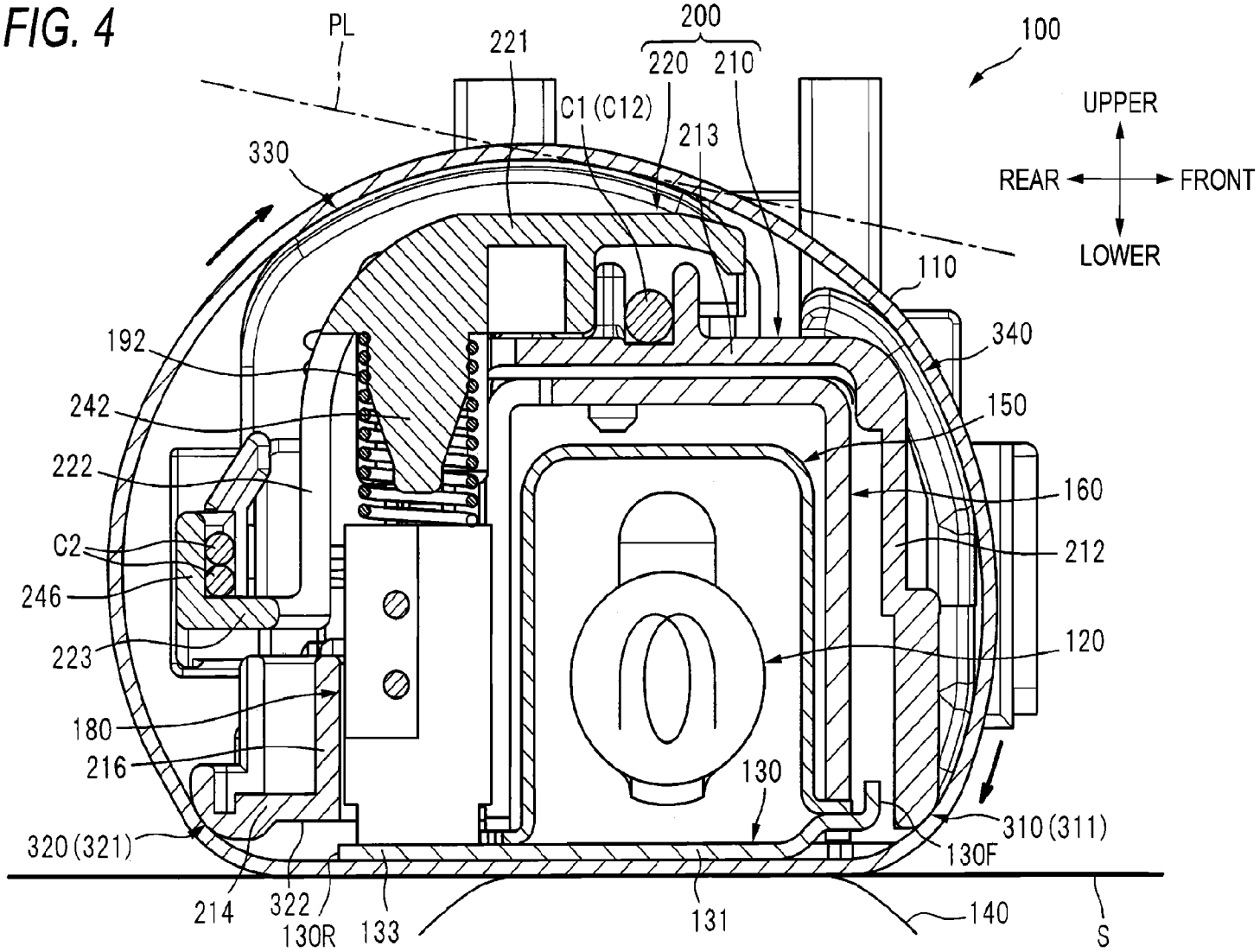
FIG. 4 is an enlarged sectional view showing a vicinity of the thermistor disposed at a center of the fixing device in a left-right direction.

The thermistor 180 is a temperature sensor that detects a temperature of the nip plate 130. As shown in FIG. 4, the thermistor 180 is arranged at an opposite side to the halogen lamp 120 with the reflection member 150 and the stay 160 being interposed between therebetween at the inside of the fixing belt 120.

More specifically, the thermistor 180 has a lower surface that is a temperature detection surface and is arranged to face an upper surface of the second extension 133. The second extension 133 is also a part that directly extends from the base part 131. Hence, the thermistor 180 is arranged to face the second extension 133, so that it is possible to detect a temperature near the nip portion N with good precision.

As shown in FIGS. 2 and 4, the thermostat 170 and the thermistors 180 are urged toward the first extension 132 and the second extensions 133 of the nip plate 130 by coil springs 191, 192, respectively. Thereby, a positional relation with the nip plate 130 that is a detection object becomes stable, so that it is possible to detect the temperature with better precision.

Figure 5:
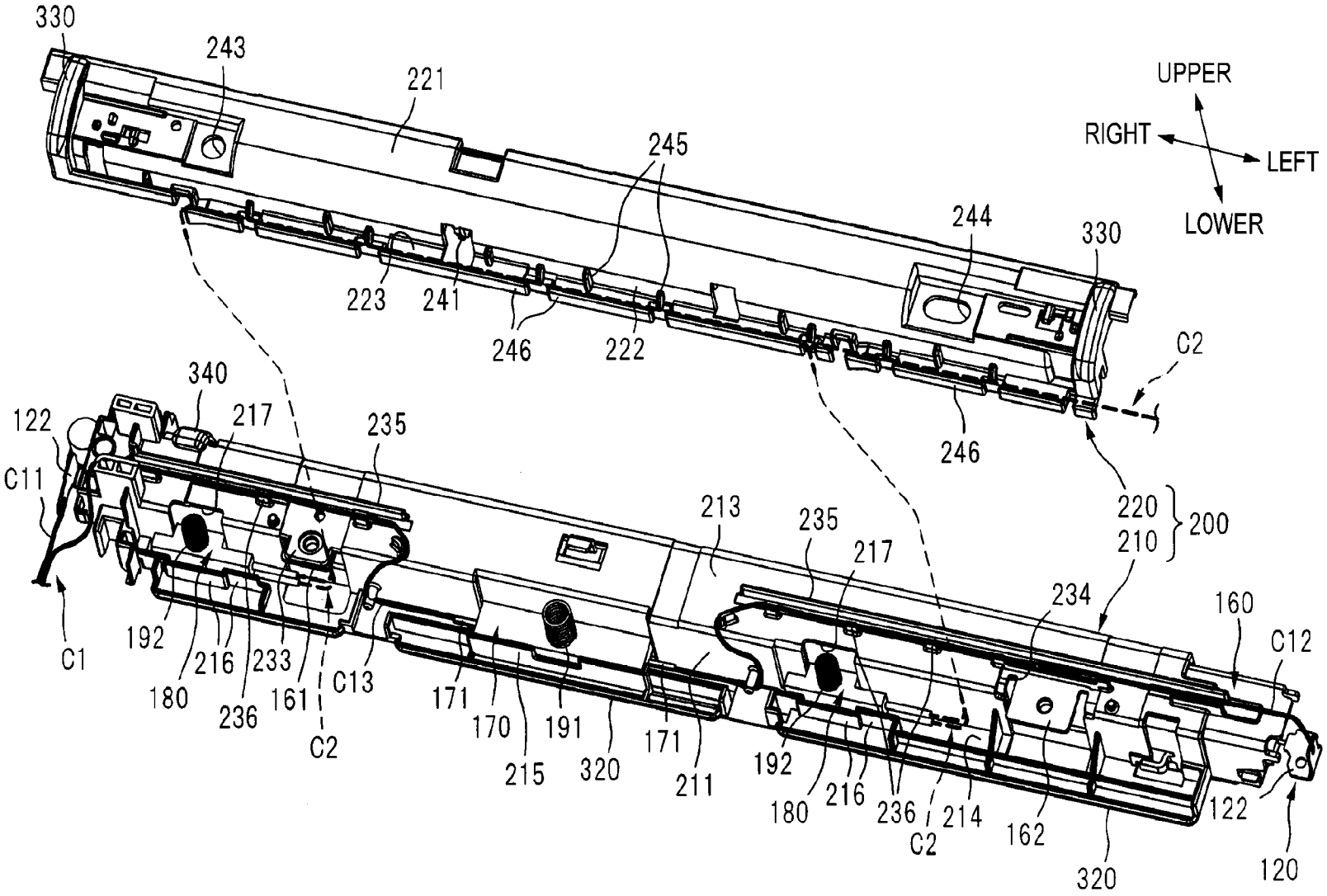
FIG. 5 is a perspective view showing arrangement of a cable.

A cable C1 shown with the thick solid line in FIG. 5 is a conducting wire for feeding power to the halogen lamp 120. The cable C1 is arranged at an opposite side to the halogen lamp 120 with the stay 160 being interposed therebetween at the inside of the fixing belt 110 (refer to FIG. 4). The cable C1 is connected to the halogen lamp 120 and the thermostat 170.

More specifically, the cable C1 includes a conducting wire C11, which is connected to the right electrode 122 of the halogen lamp 120, and conducting wires C12, C13, which are directly or indirectly connected to the left electrode 122 of the halogen lamp 120.

The conducting wire C12 extends rightward from the left electrode 122 of the halogen lamp 120 over an upper wall 213 of a first cover member 210, extends downward along a rear wall 211 near the center of the first cover member 210 in the left-right direction and is then connected to the left electrode 171 of the thermostat 170. Also, the conducting wire C13 connected to the right electrode 171 of the thermostat 170 extends upward along the rear wall 211, extends rightward over the upper wall 213 of the first cover member 210 and is taken out from the right end portion of the fixing belt 110 together with the conducting wire C11.

An end portion of the cable C1 taken out from the right end portion of the fixing belt 110 is connected to a power board (not shown) provided in the body housing 2. Thereby, it is possible to feed the power to the halogen lamp 120. Incidentally, the thermostat 170 is connected to the middle of the cable C1. Thereby, when the nip plate 130 is overheated, the thermostat 170 interrupts the power feeding, so that it is possible to rapidly cut off the power feeding to the halogen lamp 120.

A cable C2 shown with the thick broken line in FIG. 5 is a conducting wire that is connected to the thermistors 180. The cable C2 is arranged at an opposite side to the halogen lamp 120 with the stay 160 being interposed therebetween at the inside of the fixing belt 110 (refer to FIG. 4), like the cable C1.

More specifically, the cable C2 is connected to a thermistor device (not shown) arranged in a housing of the thermistor 180 and is taken out from a left end surface of the thermistor 180. The cable C2 extending from the thermistors 180 extends upward, extends leftward along a rear wall 222 of a second cover member 220, which will be described later, and is then taken out from the left end portion of the fixing belt 110.

An end portion of the cable C2 taken out from the left end portion of the fixing belt 110 is connected to a control board (not shown) provided in the body housing 2. A detection result of the thermistors 180 is output to the control board and is used to control the halogen lamp 120.

The cover member 200 is a member configured to support the thermostat 170, the thermistors 180 and the cables C1, C2. The cover member 200 is arranged to cover the stay 160 at the inside of the fixing belt 110. The cover member 200 includes the first cover member 210 and the second cover member 220.

The first cover member 210 has a substantially U-shaped section and is elongated to extend in the left-right direction. The first cover member 210 is arranged to cover the stay 160 at the opposite side to the halogen lamp 120 with the stay 160 being interposed therebetween (refer to FIGS. 2 and 4). The first cover member 210 supports the thermostat 170, the thermistors 180 and the cable C1 from one end to the other end in an axial direction, specifically from the right end to the left end.

In this exemplary embodiment, the first cover member 210 is made of resin, for example liquid crystal polymer, PEEK resin, PPS resin and the like. The rear wall 211 of the first cover member 210 is provided between the electrodes 171 of the thermostat 170 and the conductive reflection member 150 or the stay 160, so that the real wall 211 secures the insulation between the electrodes 171 and the reflection member 150 or the stay 160.

As shown in FIG. 3, the first cover member 210 includes the rear wall 211, a front wall 212, the upper wall 213 extending to connect upper ends of the rear wall 211 and the front wall 212 and an extension wall 214 extending rearward from a lower end of the rear wall 211. Also, the first cover member 210 is mainly formed with a first positioning part 231, two second positioning parts 232, a fixation part 233, a notched part 234 and ribs 235, 236.

The first positioning part 231 is a part that positions the thermostat 170. The first positioning part 231 is configured by a recess portion 211A, which is formed near a center of the rear wall 211 in the left-right direction, and an upright standing wall 215 standing upright from the extension wall 214, facing the recess portion 211A and having a substantial U shape when seen from a plan view. The thermostat 170 is disposed at the first positioning part 231 and is thus positioned in the front-rear direction and the left-right direction (refer to FIG. 5).

The second positioning part 232 is a part that positions the thermistor 180. The second positioning part 232 is configured by an upright standing wall 216, which is provided near a center and a right end of the extension wall 214 in the left-right direction, and the rear wall 211 facing the upright standing wall 216. An opening 217, into which a forward protruding part of the thermistor 180 is fitted, is formed near the center of the rear wall 211, which configures the second positioning part 232, in the left-right direction. The thermistor 180 is disposed at the second positioning part 232 and is thus positioned in the front-rear direction and the left-right direction (refer to FIG. 5).

Incidentally, since the opening 217 is formed from the rear wall 211 to the extension wall 214, the thermistor 180 can face the nip plate 130 through the opening 217. Also, a bottom wall (extension wall 214) of the first positioning part 231 includes a hole (a reference numeral thereof is omitted) that enables the thermostat 170 to face the nip plate 130.

The fixation part 233 is a part for fixing the first cover member 210 to the right fixation part 161 of the stay 160. The fixation part 233 is provided at the right side of the first cover member 210 in correspondence to the right fixation part 161. The fixation part 233 is formed with a through-hole (a reference numeral thereof is omitted) having a substantially circular shape, when seen from a plan view, corresponding to the screw hole of the right fixation part 161.

The notched part 234 is provided over the upper wall 213, the rear wall 211 and the extension wall 214 at the left side of the first cover member 210. As shown in FIG. 5, when the first cover member 210 and the stay 160 are assembled, the left fixation part 162 of the stay 160 is exposed through the notched part 234. The notched part 234 has a left-right width larger than a left-right length of the exposed left fixation part 162.

The ribs 235, 236 protrude from the upper wall 213 and are intermittently provided along the left-right direction, more specifically, along a path of the cable C1 passing over the upper wall 213. The ribs 235 and the ribs 236 are provided in a line so as to face each other in the front-rear direction, and the cable C1 is interposed between the ribs 235, 236. Thereby, it is possible to suppress the deviation of the cable C1 in the front-rear direction on the upper wall 213.

Incidentally, as shown in FIG. 2, in this exemplary embodiment, the extension wall 214 and the upright standing wall 215 of the first cover member 210 are positioned at the rear side that is the opposite side to the front side at which the halogen lamp 120 is arranged, on the basis of the thermostat 170, and serve as an 'interposition part' positioned between a part of the thermostat 170 and the fixing belt 110. By the extension wall 214 and the upright standing wall 215 serving as the interposition part, the contact between the fixing belt 110 and the thermostat 170 is suppressed.

Also, as shown in FIG. 4, the extension wall 214 and the upright standing wall 216 of the first cover member 210 are positioned at the rear side that is the opposite side to the front side at which the halogen lamp 120 is arranged, on the basis of the thermistor 180, and serve as an 'interposition part' positioned between a part of the thermistor 180 and the fixing belt 110. By the extension wall 214 and the upright standing wall 216 serving as the interposition part, the contact between the fixing belt 110 and the thermistor 180 is suppressed.

As shown in FIG. 2, the second cover member 220 has a substantially L-shaped section. The second cover member 220 is elongated to extend in the left-right direction and is arranged at the opposite side to the stay 160 with the rear wall 211 and a part of the upper wall 213 of the first cover member 210 being interposed therebetween. In other words, the second cover member 220 covers a part of the first cover member 210 from the opposite side to the stay 160. The second cover member 220 supports the cable C2.

In this exemplary embodiment, the second cover member 220 is also made of resin, for example liquid crystal polymer, PEEK resin, PPS resin and the like.

The second cover member 220 and the first cover member 210 are assembled so that the members partially overlap each other. When the second cover member 220 is assembled to the first cover member 210 so that they overlap, the cable C1 is arranged between the first cover member 210 and the second cover member 220 at the overlapping part of the upper wall 213 of the first cover member 210 and the upper wall 221 of the second cover member 220 in the upper-lower direction, as shown in FIG. 4.

Likewise, as shown in FIGS. 2 and 4, the thermostat 170 and the thermistors 180 are arranged between the first cover member 210 and the second cover member 220 at the overlapping part of the extension wall 214 of the first cover member 210 and the upper wall 221 of the second cover member 220 in the upper-lower direction.

The second cover member 220 includes the upper wall 221, the rear wall 222 extending downward from a rear end of the upper wall 221 and an extension wall 223 extending rearward from a lower end of the rear wall 222. Also, as shown in FIG. 3, the second cover member 220 is mainly formed with a first support part 241, two second support parts 242 (refer to FIG. 4 in which only one is shown), a circular hole 243, an elliptical hole 244 and ribs 245, 246.

As shown in FIG. 2, the first support part 241 is a part supporting the coil spring 191. The first support part 241 protrudes downward from a central part (part corresponding to the first positioning part 231 of the first cover member 210) of the upper wall 221 in the left-right direction. The coil spring 191 is engaged with the first support part 241 and is thus supported by the cover member 200.

As shown in FIG. 4, the second support parts 242 are parts supporting the coil springs 192. The second support parts 242 protrude downward from the central part and right end (e.g., parts corresponding to the second positioning parts 232 of the first cover member 210) of the upper wall 221 in the left-right direction. The coil springs 192 are engaged to the second support parts 242 and are thus supported by the cover member 200.

As shown in FIG. 3, the circular hole 243 is a substantially circular through-hole formed at the right side of the upper wall 221, when seen from a plan view, in correspondence to the screw hole of the right fixation part 161 of the stay 160. The elliptical hole 244 is a substantially oval through-hole formed at the left side of the upper wall 221, when seen from a plan view, in correspondence to the screw hole of the left fixation part 162 of the stay 160.

The ribs 245, 246 protrude from the extension wall 223 and are intermittently provided along a path of the cable C2. More specifically, the ribs 245 are provided at corners of the extension wall 223 and the rear wall 222 so as to connect the extension wall and the rear wall, and the ribs 246 are provided to upright stand from a rear end of the extension wall 223. The ribs 245 and the ribs 246 face each other in the front-rear direction, and the cable C2 extending from the thermistors 180 is interposed between the ribs 245, 246 on the extension wall 223, as shown in FIG. 5. By this configuration, it is possible to suppress the cable C2 from falling off from the extension wall 223.

Also, as shown in FIG. 4, in this exemplary embodiment, the upper wall 221 of the second cover member 220 is positioned at the upper side that is the opposite side to the lower side at which the halogen lamp 120 is arranged, on the basis of the cable C1, and serves as an 'interposition part' positioned between the cable C1 and the fixing belt 110. More specifically, the upper wall 221 is provided between the cable C1 and the fixing belt 110, so that the upper wall 221 covers the entire part of the cable C1 arranged on the upper wall 221. By the upper wall 221 serving as the interposition part, the contact between the fixing belt 110 and the cable C1 is suppressed.

Also, the ribs 246 of the second cover member 220 are positioned at the rear side that is the opposite side to the front side at which the halogen lamp 120 is arranged, on the basis of the cable C2, and serve as an 'interposition part' positioned between the cable C2 and the fixing belt 110. By the ribs 246 serving as the interposition part, the contact between the fixing belt 110 and the cable C2 is suppressed.

Regarding the above configuration, both the interposition part (e.g., the extension wall 214 and the upright standing walls 215, 216) provided to the first cover member 210 and the interposition part (e.g., the upper wall 221 and the ribs 246) provided to the second cover member 220 are formed of the resin (e.g., insulating material). Hence, the contact between the fixing belt 110 and the electric parts such as cable C1 is suppressed by the interposition parts, so that it is possible to secure the insulation between the fixing belt 110 and the electric part.

As shown in FIG. 4, the cover member 200 is formed with a guide part that slidingly contacts the inner peripheral surface of the fixing belt 110 being rotating and thus guides the inner peripheral surface of the fixing belt 110. Specifically, the cover member 200 includes, as the guide part, a nip upstream guide 310, nip downstream guides 320, upper guides 330 that are one example of an extension-side guide part and a front part guide 340.

The nip upstream guide 310 is a guide that guides the fixing belt 110 toward between the nip plate 130 and the pressing roller 140. The nip upstream guide 310 is formed at a lower end portion of the front wall 212 of the first cover member 210. More specifically, the nip upstream guide 310 is arranged at a just upstream side (e.g., one side in the conveyance direction of the sheet S) of an upstream-side end portion 130F of the nip plate 130 in a rotating direction (e.g., clockwise direction in FIG. 4) of the fixing belt 110, and forms a curved shape having a convex section toward the inner peripheral surface of the fixing belt 110. That is, the nip upstream guide 310 includes a guide surface 311 of the curved shape guiding the inner peripheral surface of the fixing belt 110.

Figure 6:
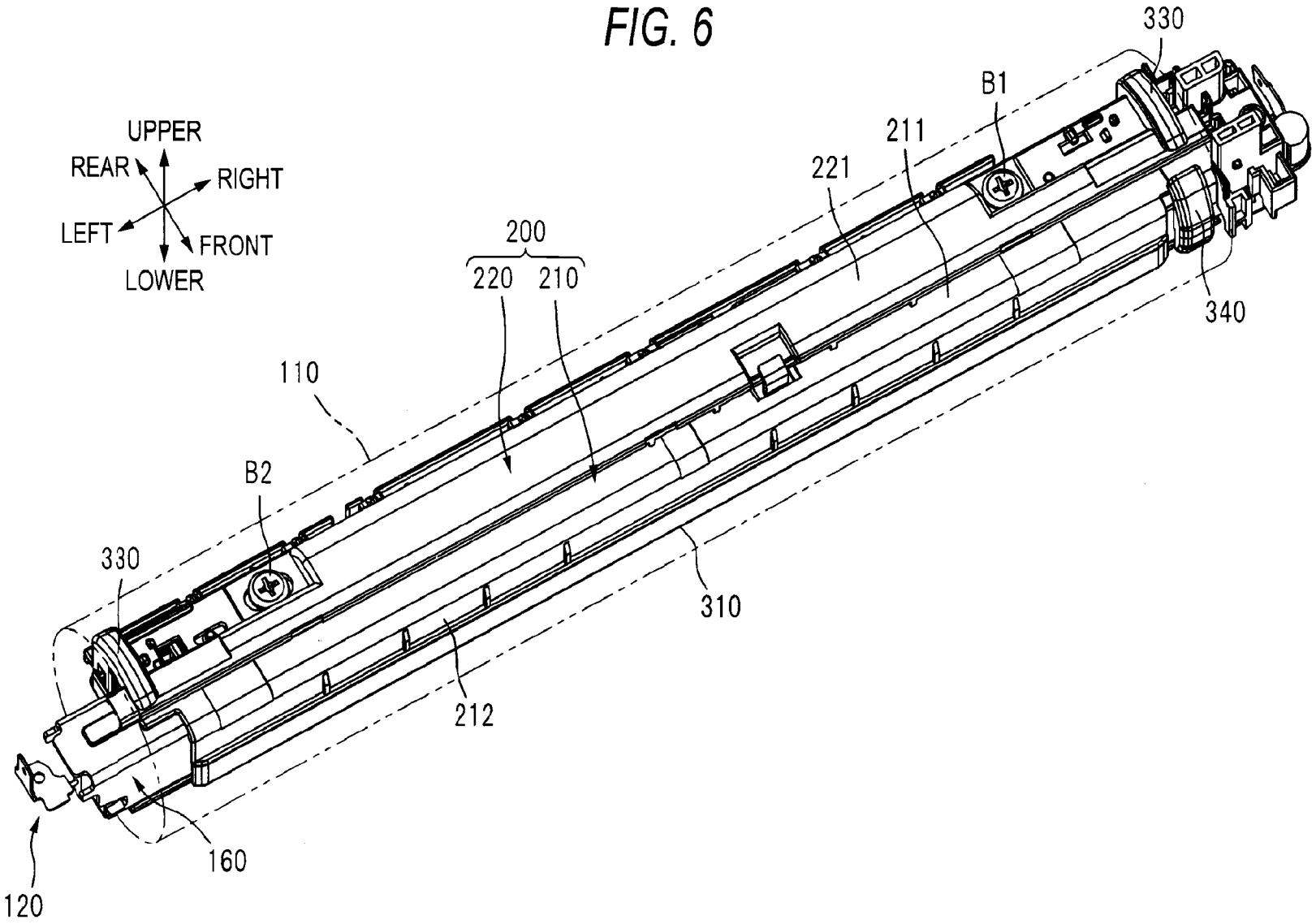
FIG. 6 is a perspective view of the cover member, which is seen from the front side.

As shown in FIG. 6, the nip upstream guide 310 is continuously provided over the substantial overall range of the fixing belt 110 in the axial direction (left-right direction). By virtue of the nip upstream guide 310, it is possible to favorably guide the fixing belt 110 toward between the nip plate 130 and the pressing roller 140.

Also, the nip upstream guide 310 is arranged with being spaced from the upstream-side end portion 130F of the nip plate 130, so that the nip upstream guide 310 does not contact the nip plate 130 over the entire range thereof in the left-right direction. Thereby, it is possible to prevent the heat from the nip plate 130 from being transferred to the nip upstream guide 310, and thus it is possible to improve the heat fixing characteristic.

Back to FIG. 4, the nip downstream guides 320 are guides that guide the fixing belt 110 delivered from between the nip plate 130 and the pressing roller 140. The nip downstream guides 320 are formed at the rear end portion (e.g., interposition part) of the extension wall 214 of the first cover member 210. More specifically, the nip downstream guides 320 are arranged at a just downstream side (e.g., the other side in the conveyance direction of the sheet S) of a downstream-side end portion 130R of the nip plate 130 in the rotating direction of the fixing belt 110, and form a curved shape having a convex section toward the inner peripheral surface of the fixing belt 110, respectively. That is, the nip downstream guides 320 include a guide surface 321 of the curved shape guiding the inner peripheral surface of the fixing belt 110, respectively.

By virtue of the nip downstream guides 320, it is possible to stably advance the fixing belt 110 delivered from between the nip plate 130 and the pressing roller 140.

Incidentally, in this exemplary embodiment, the nip downstream guides 320 are intermittently provided along the left-right direction, as shown in FIG. 3 or 5. Alternatively, like the nip upstream guide 310, the nip downstream guides 320 may be continuously provided over the substantial overall range of the fixing belt 110 in the axial direction.

In the above description, the just upstream side means that another guide for guiding the rotation of the fixing belt 110 is not provided between the nip upstream guide 310 and the nip plate 130 in the rotating direction of the fixing belt 110, and the just downstream side means that another guide for guiding the rotation of the fixing belt 110 is not provided between the nip plate 130 and the nip downstream guides 320 in the rotating direction.

Also, the nip downstream guides 320 are arranged with being spaced from the downstream-side end portion 130R of the nip plate 130, so that the nip downstream guides do not contact the nip plate 130 over the entire range thereof in the left-right direction. Thereby, since it is possible to prevent the heat from the nip plate 130 from being transferred to the nip downstream guides 320, it is possible to improve the heat fixing characteristic.

Figure 7:
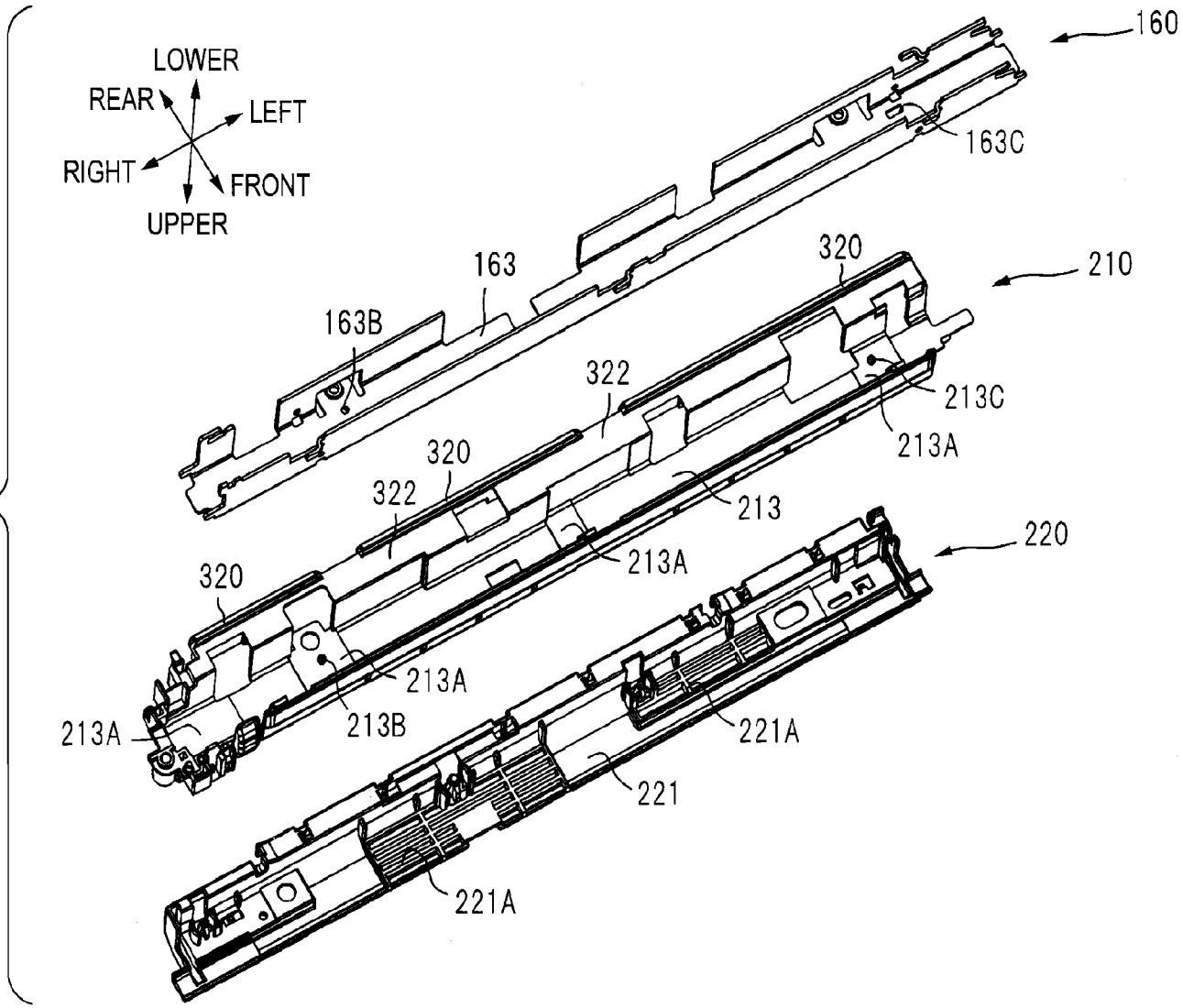
FIG. 7 is a perspective view of the stay, the first cover member and the second cover member, which is seen from the lower side.
Figure 8:
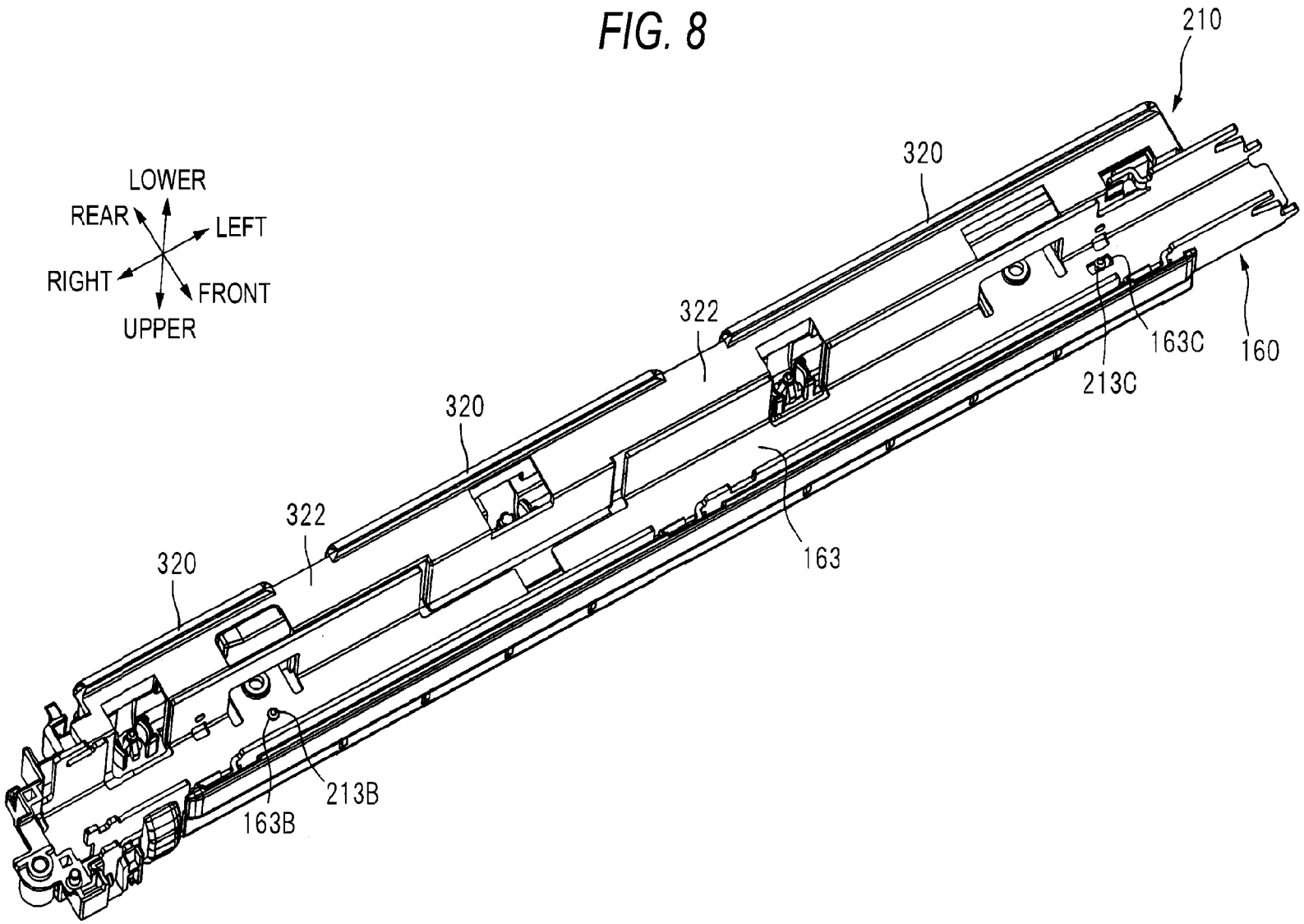
FIG. 8 is a perspective view showing the first and second cover members assembled to the stay, which is seen from the lower side.
Figure 9:
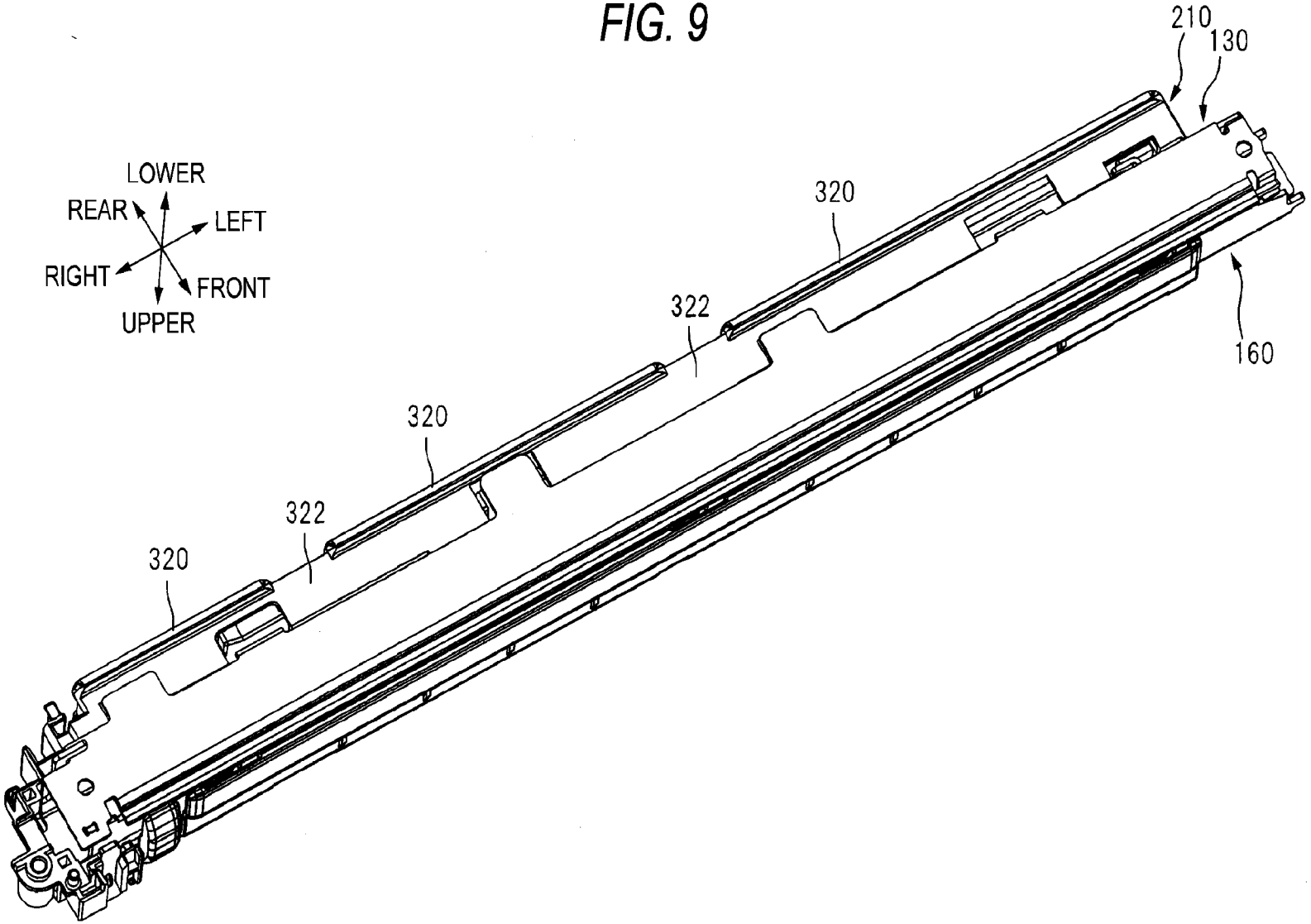
FIG. 9 is a perspective view showing the nip plate assembled to the structure of FIG. 8, which is seen from the lower side.

Also, a side of the nip downstream guide 320, which is closer to the nip plate 130 than the guide surface 321, is formed with a step part 322 that is more concave than the guide surface 321 in the upper side direction (e.g., the halogen lamp 120-side in the direction that the nip plate 130 and the pressing roller 140 face each other). The step part 322 is formed over the substantially entire range (e.g., the entire range in the width direction) of the first cover member 210 in the left-right direction, as shown in FIGS. 7 to 9 showing the respective members from the lower side.

Thereby, it is possible to securely space the part of the nip downstream guide, which is closer to the nip plate 130 than the guide surface 321, from the fixing belt 110. Accordingly, it is possible to smoothly rotate the fixing belt 110.

As shown in FIG. 4, the upper guides 330 are guides that guide an upper part of the fixing belt 110. The upper guides 330 are formed at the upper wall 221 (e.g., interposition part) of the second cover member 220 arranged at the opposite upper side to the nip plate 130 with the halogen lamp 120 being interposed therebetween. In other words, the upper guides 330 are positioned at the upper side (e.g., the halogen lamp 120-side in the direction that the nip plate 130 and the pressing roller 140 face each other) regarding the extensions 132, 133 of the nip plate 130, thereby guiding the inner peripheral surface of the fixing belt 110. Thereby, it is possible to suppress the fixing belt 110 from being largely bent at the nip downstream sides 320 by the upper guides 330. Accordingly, it is possible to suppress the deterioration of the fixing belt 110.

More specifically, as shown in FIG. 6, the upper guides 330 are provided only at both ends of the upper wall 221 in the axial direction of the fixing belt 110 so that they protrude upward, and form a curved shape convex toward the inner peripheral surface of the fixing belt 110, respectively.

As shown in FIG. 4, the front part guide 340 is a guide that guides the front part of the fixing belt 110 and is formed at the front wall 212 of the first cover member 210. More specifically, the front part guide 340 is provided only at the right end of the front wall 212 so that it protrudes forward, and forms a curved shape convex toward the inner peripheral surface of the fixing belt 110, when seen from the left-right direction.

In this exemplary embodiment, the front part guide 340 is arranged at a lower side (e.g., halogen lamp 120-side) of a plane PL, which abuts on a downstream end portion of the fixing belt 110 in the rotating direction, of planes on which the guide surface of the upper guide 330 and the inner peripheral surface of the fixing belt 110 abut.

A seam is formed between the upper guide 330 provided to the second cover member 220 and the front part guide 340 provided to the first cover member 210. However, by providing the front part guide 340 as described above, it is possible to smoothly guide the fixing belt 110 from the upper guide 330 to the front part guide 340.

By providing the upper guides 330 and the front part guide 340 as described above, it is possible to stably advance the fixing belt 110 at the upper part and the front part of the cover member 200. Also, in this exemplary embodiment, since the upper guides 330 are provided only at both left and right ends and the front part guide 340 is provided only at the right end, it is possible to reduce the sliding resistance between the inner peripheral surface of the fixing belt 110 and the upper guides 330 or front part guide 340. Thereby, it is possible to favorably rotate the fixing belt 110.

As shown in FIG. 7, four spacer parts 213A, which are one example of a spacer member (e.g., first support member), are formed at a lower surface of the upper wall 213 of the first cover member 210. In other words, each space part 213A is provided between the stay 160 and the first cover member 210 (e.g., upper wall 213). Thereby, a gap is formed between the stay 160 and the upper wall 213 of the first cover member 210.

Figure 10:
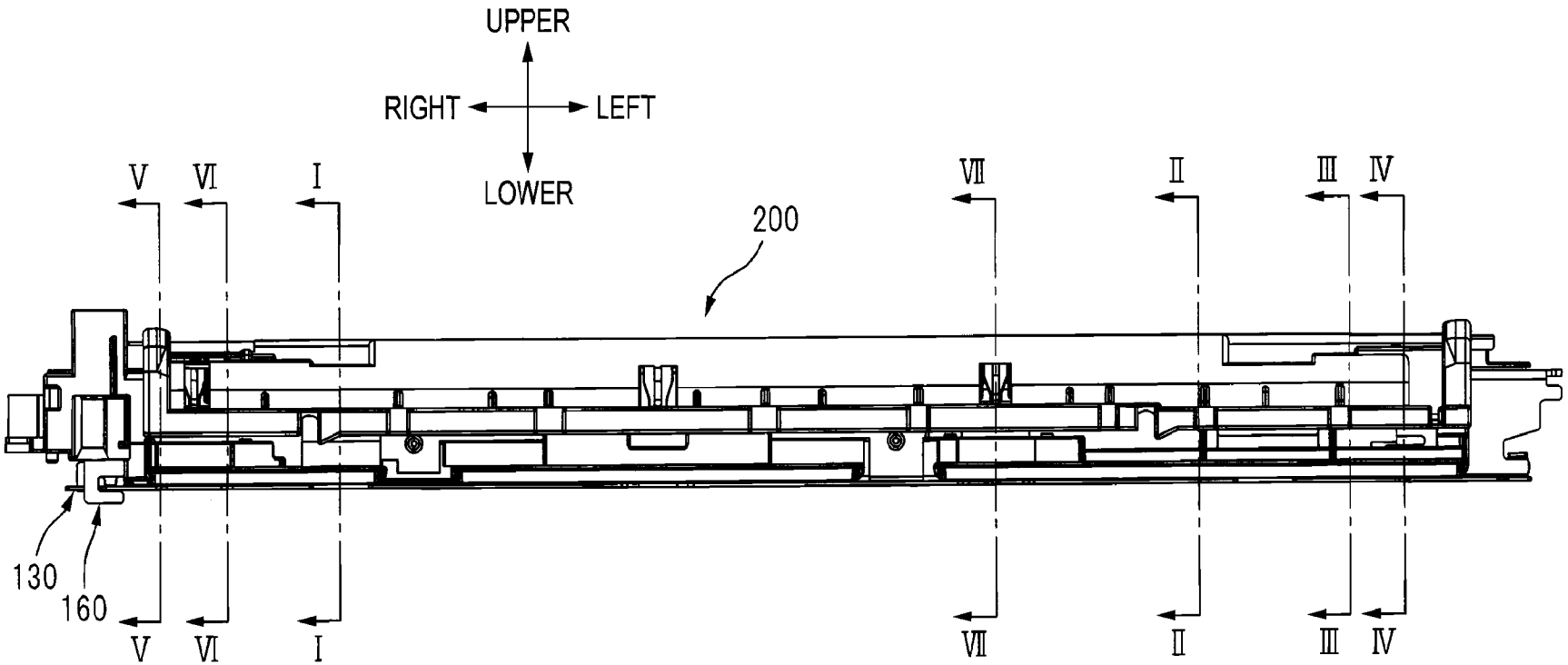
FIG. 10 is a rear view of the structure of FIG. 9, which is seen from the rear side.
Figure 11A:
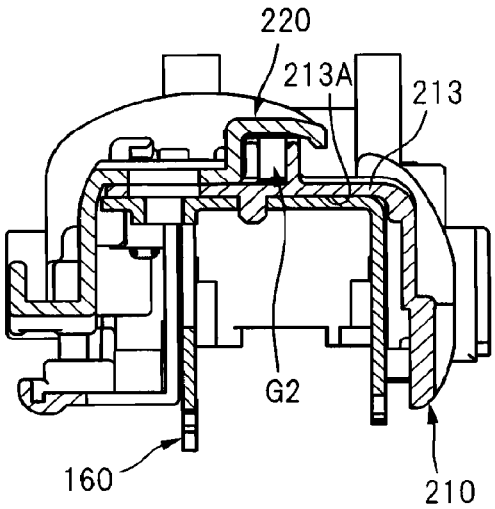
FIG. 11A is a sectional view taken along a line I-I of FIG. 10.
Figure 11B:
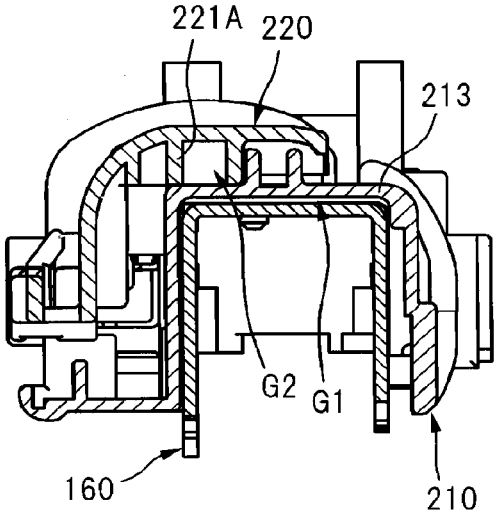
FIG. 11B is a sectional view taken along a line II-II of FIG. 10.
Figure 11C:
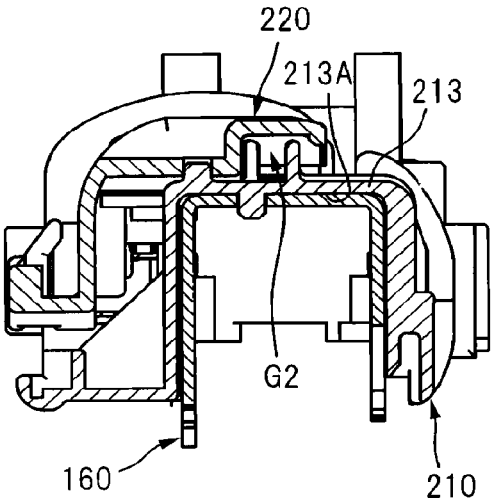
FIG. 11C is a sectional view taken along a line III-III of FIG. 10
Figure 11D:
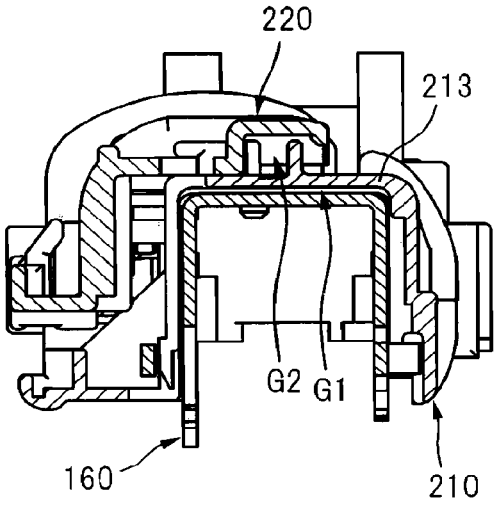
FIG. 11D is a sectional view taken along a line IV-IV of FIG. 10.
Figure 12A:
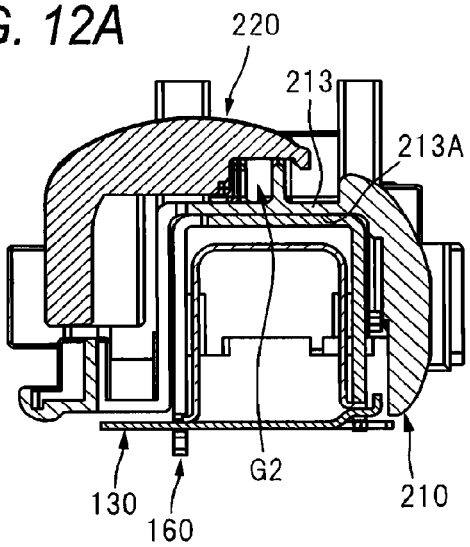
FIG. 12A is a sectional view taken along a line V-V of FIG. 10.
Figure 12B:
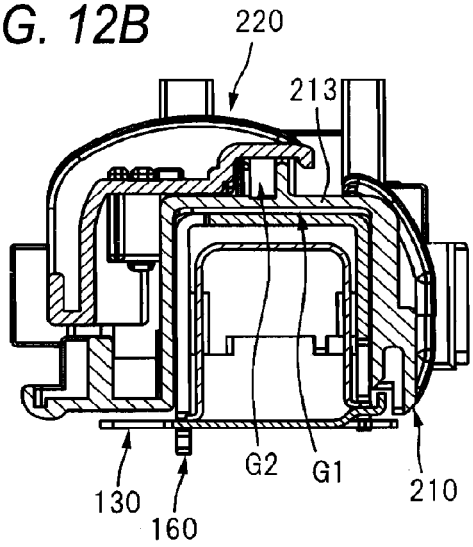
FIG. 12B is a sectional view taken along a line VI-VI of FIG. 10
Figure 12C:
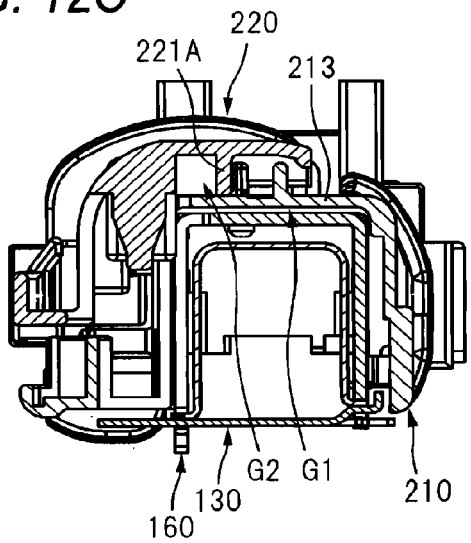
FIG. 12C is a sectional view taken along a line VII-VII of FIG. 10.

Specifically, as shown in FIGS. 10 to 12, in respective left and right sectional views of the structure having the cover member 200, the stay 160 and the like, at positions at which the spacer parts 213A are formed (for example, refer to FIG. 11A), the first cover member 210 is supported by the spacer parts 213A. In other words, at positions at which the spacer parts 213A are formed, the spacer parts 213A contact the stay 160 and support the first cover member 210. Also, at positions at which the spacer parts 213A are not formed (for example, refer to FIG. 11B), a gap G1 is formed between the upper wall 213 of the first cover member 210 and the stay 160. Thereby, the gap G1 becomes a thermal insulation layer. Therefore, it is possible to suppress the heat from escaping from the stay 160 to the outside, so that it is possible to efficiently heat the nip plate 130. Incidentally, in FIG. 11, the nip plate 11 is omitted for convenience.

As shown in FIG. 7, the respective spacer parts 213A have a step shape protruding downward from the lower surface of the upper wall 213, respectively. The spacer parts 213A are disposed at an interval in the left-right direction (e.g., width direction of the sheet S). Thereby, it is possible to suppress the first cover member 210 from rattling relative to the stay 160.

The respective spacer parts 213A are integrated with the first cover member 210 made of resin. Thereby, it is possible to reduce the number of parts, compared to a configuration where the space member and the first cover member are separately provided.

Incidentally, in this exemplary embodiment, since the first cover member 210 is made of resin, the thermal insulating properties of the first cover member 210 are improved, compared to a configuration where the first cover member is made of metal. Therefore, it is possible to suppress the heat in the space between the first cover member 210 and the stay 160 from escaping to the outside of the first cover member 210 and to thus suppress the temperature of the space from being lowered. As a result, it is possible to further suppress the heat from escaping from the stay 160 to the space.

Also, the spacer part 213A at the right end of the first cover member 210 (specifically, second spacer part from the right side) and the spacer part 213A at the left end of the first cover member 210 (specifically, leftmost spacer) are formed with cylindrical positioning protrusions 213B, 213C protruding from substantially central portions of lower surfaces of the spacer parts 213A toward the lower side (stay 160-side).

Also, the upper wall part 163 of the stay 160 is formed with positioning holes 163B, 163C into which the positioning protrusions 213B, 213C are engaged. Specifically, the right positioning hole 163C is a circular hole, and the right positioning protrusion 213B is fitted into the positioning hole 163B, so that the first cover member 210 is positioned in all direction with respect to the stay 160.

Also, the left positioning hole 163C is an oval hole extending in the left-right direction. By engaging the left positioning protrusion 213C into the positioning hole 163C, the first cover member 210 is positioned in the front-rear direction with respect to the stay 160, and the thermal expansion of the first cover member 210 in the left-right direction is absorbed.

As described above, the positioning protrusions 213B, 213C are formed on the spacer parts 213A coming down from the lower surface of the upper wall 213. Thereby, it is possible to lower the height of the positioning protrusions 213B, 213C, as the spacer parts 213A, compared to a structure where the positioning protrusions are formed on the lower surface of the upper wall 213. Therefore, it is possible to increase the rigidity of the positioning protrusions 213B, 213C.

Ribs 221A, which are one example of a second support member, are formed at a lower surface of the upper wall 221 of the second cover member 220. The ribs 221A extend in all direction in a lattice form and are formed at positions that are deviated leftward and rightward from the central portion of the upper wall 221, at an interval, respectively.

The ribs 221A are arranged between the upper wall 221 of the second cover member 220 and the upper wall 213 of the first cover member 210, thereby supporting the upper wall 221 of the second cover member 220 with being spaced from the upper wall 213 of the first cover member 210. Thereby, a gap G2 (refer to FIGS. 10 to 12) is formed between the upper wall 221 of the second cover member 220 and the upper wall 213 of the first cover member 210.

Thereby, the air layer for thermal insulation is configured with two layers (the gaps G1, G2). Therefore, it is possible to further suppress the heat from escaping from the stay 160 to the outside, thereby heating the nip plate 130 more efficiently.

In the below, a method of assembling the stay 160, the thermostat 170, the thermistors 180, the coil springs 191, 192 and the cover member 200 will be described.

From the state shown in FIG. 3, the first cover member 210 is assembled to the stay 160 so that the cover member 210 covers the stay 160. At this time, as shown in FIGS. 7 and 8, the positioning protrusions 213B, 213C are inserted into the positioning holes 163B, 163C of the stay 160, so that the first cover member 210 is positioned with respect to the stay 160.

After that, as shown in FIG. 3, the thermostat 170 is arranged at the first positioning part 231 of the first cover member 210, and the thermistors 180 are arranged at each of the second positioning parts 232. Also, the coil spring 191 is attached to the first support part 241 of the second cover member 220, and the coil springs 192 are attached to the second support parts 242. Then, the second cover member 220 is assembled to the first cover member 210 assembled to the stay 160, so that the second cover member 220 overlaps the first cover member 210.

Figure 13A:
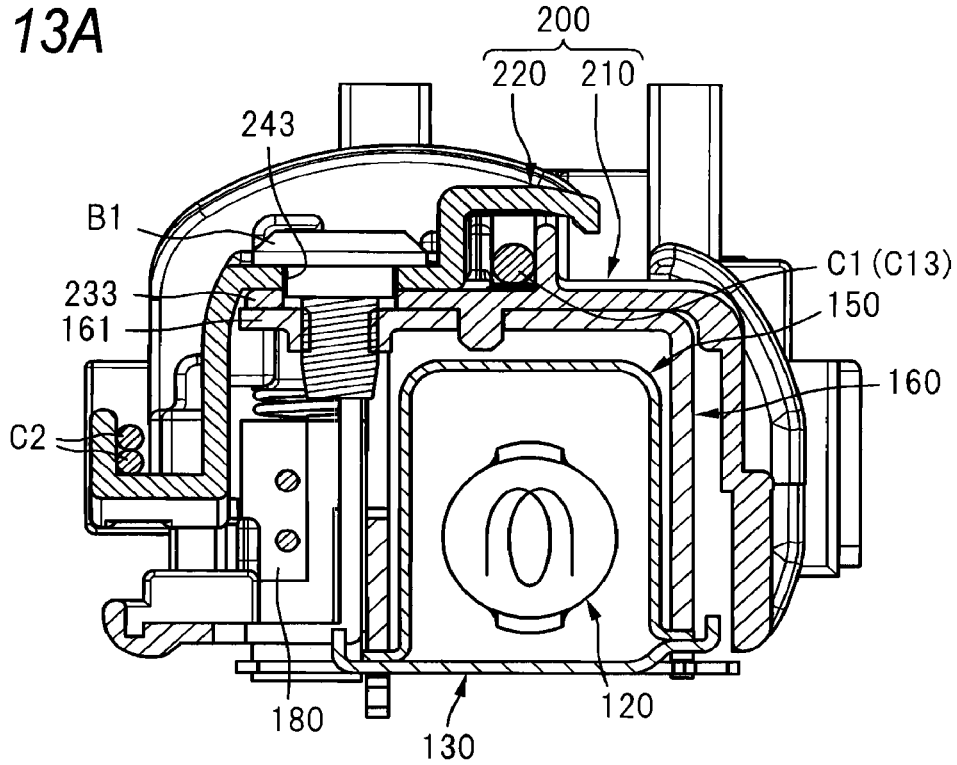
FIG. 13A is a sectional view showing a vicinity of a right fixation part and FIG. 13B is a sectional view showing a vicinity of a left fixation part.

Then, as shown in FIG. 13A, a screw B1 is enabled to pass through the circular hole 243 of the second cover member 220 and the circular through-hole of the first cover member 210 (e.g., fixation part 233) and is screwed into the screw hole of the right fixation part 161 of the stay 160. Thereby, the first cover member 210 and the second cover member 220, i.e., the cover member 200 is fixed to the stay 160 with the right side (e.g., one side in the axial direction) thereof being positioned in the left-right direction with respect to the stay 160.

Figure 13B:
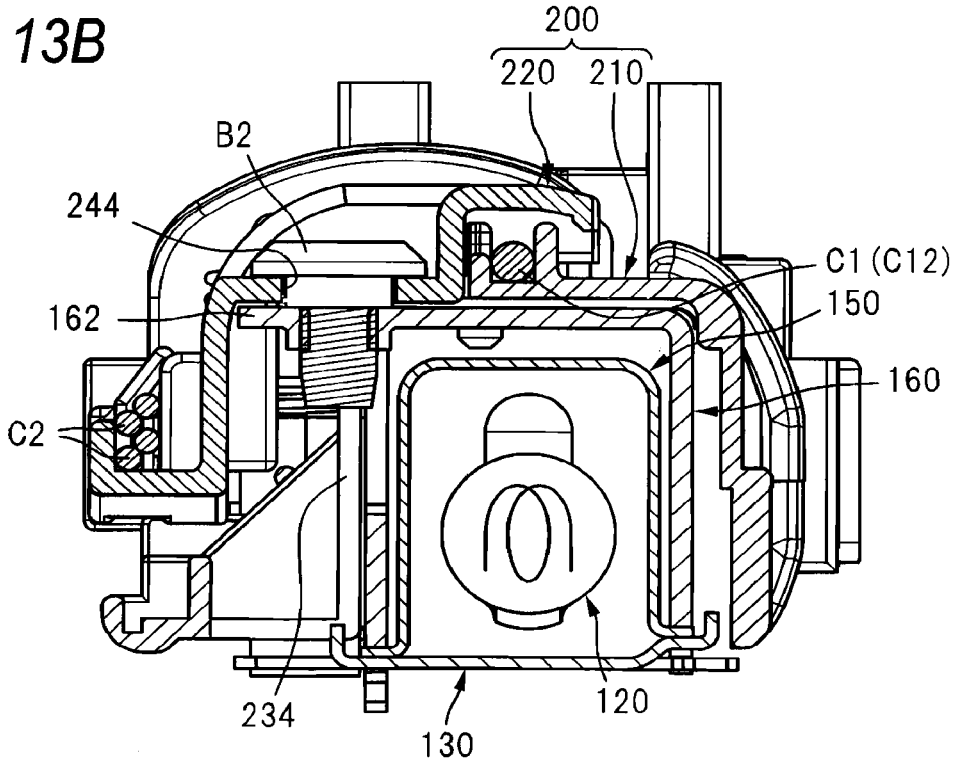

Also, as shown in FIG. 13B, a screw B2 is enabled to pass through the elliptical hole 244 of the second cover member 220 and the notched part 234 of the first cover member 210 and is screwed into the screw hole of the left fixation part 162 of the stay 160. Here, the notched part 234 has a left-right width larger than a left-right length of the left fixation part and the elliptical hole 244 is a long through-hole in the left-right direction. Thus, the cover member 200 is fixed to the stay 160 with the left side (e.g., the other side in the axial direction) thereof playing in the left-right direction with respect to the screw B2 for fixing the cover member 200 to the stay 200.

Thereby, the stay 160, the thermostat 170, the thermistors 180, the coil springs 191, 192 and the cover member 200 are assembled.

Incidentally, in this exemplary embodiment, as described above, (1) the first cover member 210, (2) the thermostat 170 and the thermistors 180 and (3) the second cover member 220 supporting the coil springs 191, 192 can be assembled to the stay 160 in order of (1), (2) and (3). Thereby, for example, it is possible to improve the assembling characteristics, compared to a configuration where the thermostat 170, the coil spring 191 and the like are assembled to the cover member that is one part.

Also, the cover member 200 is fixed to the stay 160 with the right side thereof being positioned and with the left side playing in the left-right direction with respect to the screw B2. Thus, even when the stay 160 or cover member 200 is linearly expanded due to the heat transfer thereto, the expansion can be absorbed. Thereby, the deformation of the stay 160 or cover member 200 can be suppressed.

<Modification to Exemplary Embodiments>

Although the exemplary embodiment of the invention has been described, it should be understood that the invention is not limited to the exemplary embodiment. The specific configuration can be appropriately changed without departing from the scope of the invention.

In the above-described exemplary embodiment, the spacer member (e.g., spacer parts 213A) that is disposed between the upper wall 213 of the first cover member 210 and the stay 160 has been adopted as the first support member. However, the invention is not limited thereto. For example, any member may be possible insomuch as it supports the first cover member so that a gap is formed between the stay and the cover member. Also, the second support member is not limited to the ribs 221A that are disposed between the upper wall 221 of the second cover member 220 and the first cover member 210. That is, any member may be possible insomuch as it supports the second cover member so that a gap is formed between the second cover member and the first cover member. For example, members to be arranged at both left and right ends of the cover member (for example, members for guiding the rotation of the cylindrical member) may support the first cover member so that a gap is formed between the first cover member and the stay, or may support the second cover member so that a gap is formed between the second cover member and the first cover member.

In the above-described exemplary embodiment, the nip plate 130 having a plate shape has been adopted as the nip member. However, the invention is not limited thereto. For example, a thick member, other than the plate shape, may be also possible.

In the above-described exemplary embodiment, the spacer member (e.g., spacer parts 213A) is integrated with the first cover member 210. However, the invention is not limited thereto. For example, the spacer member may be separately configured from the first cover member.

In the above-described exemplary embodiment, the upper guides 330 that are one example of an extension-side guide part are provided only at both ends of the fixing belt 110 in the axial direction. However, the invention is not limited thereto. For example, the extension-side guide part may be intermittently provided along the axial direction of the cylindrical member or may be provided over the entire range thereof in the axial direction.

In the above-described exemplary embodiment, the cover member 200 is fixed to the stay 160 with the right side thereof being positioned and with the left side playing in the left-right direction with respect to the screw B2 (fastening tool). However, the invention is not limited thereto. For example, the cover member may be fixed to the stay with the center thereof being positioned in the axial direction of the cylindrical member and with both ends thereof playing in the left-right direction with respect to the fastening tool.

In the above-described exemplary embodiment, the first cover member 210 and the second cover member 220 are fixed to the stay 160 by the common screws B1, B2. However, the invention is not limited thereto. For example, the first cover member and the second cover member may be fixed to the stay by separate screws.

In the above-described exemplary embodiment, the first cover member 210 and the second cover member 220 are assembled with partially overlapping each other. However, the invention is not limited thereto. For example, when overlapping each other, one cover may completely cover the other cover.

In the above-described exemplary embodiment, the cover member is configured by the two covers (e.g., parts). However, the invention is not limited thereto. For example, the cover member may be configured by one part or three or more parts.

In the above-described exemplary embodiment, the pressing roller 140 has been exemplified as the backup member. However, the invention is not limited thereto. For example, a pressing member having a belt shape may be also used.

In the above-described exemplary embodiment, the halogen lamp 120 (e.g., halogen heater) has been exemplified as the heating member. However, the invention is not limited thereto. For example, a carbon heater, an IH heater and the like may be also used.

In the above-described exemplary embodiment, the fixing belt 110 (e.g., cylindrical member) is made of metal. However, the invention is not limited thereto. For example, the fixing belt may be formed of resin such as polyimide resin and the like, or may be formed of a material having elasticity such as rubber. Also, the cylindrical member may have a multi-layered structure. Specifically, the fixing belt may have a structure where a resin layer and the like for reducing the sliding resistance is provided on a surface of a metal belt, or may have a structure where an elastic layer such as rubber is provided on a surface of a metal belt.

In the above-described exemplary embodiment, the configuration where both the reflection member 150 and the stay 160 are provided has been exemplified. However, the invention is not limited thereto. For example, a configuration where only the stay is provided may be also possible. Incidentally, in a configuration where only the stay is provided e.g., the reflection member is not provided), the stay may have a reflective surface at a side facing the heater, which reflects the radiation heat from the heater toward the nip plate (that is, the stay and the reflection member may be integrally configured).

In the above-described exemplary embodiment, the sheet S such as normal sheet and postcard has been exemplified as the recording sheet. However, the invention is not limited thereto. For example, an OHP sheet and the like may be used.

In the above-described exemplary embodiment, the laser printer that forms a black-and-white image has been exemplified as the image forming apparatus having the fixing device of the invention. However, the invention is not limited thereto. For example, a printer that forms a color image may be also possible. Also, the image forming apparatus is not limited to the printer and may be a copier or complex machine having a document reading device such as flat bed scanner.

What is claimed is:

1. A fixing device comprising:
a flexible cylindrical member;
a nip member contactable with an inner peripheral surface of the flexible cylindrical member;
a heater extending inside the flexible cylindrical member;
a stay extending inside the flexible cylindrical member; and
a cover member, the cover member comprising:
a surface facing the stay; and
a support member protruding from the surface toward the stay, the support member being opposite to the heater relative to a portion of the stay, the support member contacting the portion of the stay to form a gap between the stay and at least a portion of the surface of the cover member, the support member comprising:
a central portion contacting the stay;
a first portion contacting the stay, the first portion being spaced apart from the central portion; and
a second portion contacting the stay, the second portion being spaced apart from the central portion, the second portion being opposite to the first portion relative to an imaginary plane that passes through the central portion and is perpendicular to an longitudinal direction of the heater.

2. The fixing device according to claim 1,
wherein the stay has:
a first hole; and
a second hole that is an elongated hole, and
wherein the cover member further comprises:
a first protrusion having at least a portion disposed inside the first hole of the stay; and
a second protrusion having at least a portion disposed inside the second hole of the stay.

3. The fixing device according to claim 2, wherein the support member is disposed between the first protrusion and the second protrusion in a longitudinal direction of the heater.

4. The fixing device according to claim 1, wherein the heater comprises a halogen lamp.

5. The fixing device according to claim 1, further comprising a reflection member configured to reflect radiant heat from the heater, the portion of the stay being disposed between the reflection member and the support member of the cover member, the portion of the stay being disposed between the heater and the support member of the cover member.

6. The fixing device according to claim 5, further comprising a roller contactable with an outer peripheral surface of the flexible cylindrical member, the roller being rotatable about an axis,
wherein a portion of the nip member is disposed between the support member and the axis of the roller, and
wherein the portion of the nip member is disposed between the heater and the axis of the roller.

7. The fixing device according to claim 5, wherein the cover member has a U-shape defining an internal space therein, at least a portion of the stay being disposed inside the internal space of the cover member, the supporting member being disposed inside the internal space of the cover member.

8. The fixing device according to claim 7, wherein the stay has a U-shape defining an internal space therein, at least a portion of the reflection member being disposed inside the internal space of the stay.

9. A fixing device comprising:
a flexible cylindrical member;
a nip member contactable with an inner peripheral surface of the flexible cylindrical member;
a heater extending inside the flexible cylindrical member;
a stay extending inside the flexible cylindrical member, wherein the stay comprises metal; and
a cover member comprising resin, the cover member including:
a surface facing the stay; and
a support member protruding from the surface toward the stay, the support member being opposite to the heater relative to a portion of the stay, the support member contacting the portion of the stay to form a gap between the stay and at least a portion of the surface of the cover member.

10. The fixing device according to claim 9, wherein the cover member comprises at least one of liquid crystal polymer, PEEK resin, and PPS resin.

11. A fixing device comprising:
an endless belt;
a nip plate contactable with an inner peripheral surface of the endless belt;
a heater extending inside the endless belt;
a stay extending inside the endless belt; and
a wall, the wall comprising:
a surface extending along the stay, at least a portion of the surface being spaced apart from the stay; and
a contact portion extending from the surface toward the stay, the stay having a portion disposed between the contact portion and the heater, the contact portion contacting the portion of the stay,
wherein the surface of the wall comprises:
a first portion spaced apart from the stay; and
a second portion spaced apart from the stay, the second portion being opposite to the first portion relative to the contact portion in a longitudinal direction of the heater, the contact portion connecting the first portion and the second portion along a longitudinal direction of the heater.

12. A fixing device comprising:
an endless belt;
a nip plate contactable with an inner peripheral surface of the endless belt;
a heater extending inside the endless belt;
a stay extending inside the endless belt; and
a wall, the wall comprising:
a surface extending along the stay, at least a portion of the surface being spaced apart from the stay; and
a contact portion extending from the surface toward the stay, the stay having a portion disposed between the contact portion and the heater, the contact portion contacting the portion of the stay,
wherein the stay comprises a metal stay, and
wherein the wall comprises a resin wall.

13. The fixing device according to claim 12,
wherein the stay has:
a first hole; and
a second hole that is an elongated hole,
wherein the wall further comprises:
a first protrusion having at least a portion disposed inside the first hole of the stay; and
a second protrusion having at least a portion disposed inside the second hole of the stay.

14. The fixing device according to claim 13, further comprising a reflection member configured to reflect radiant heat from the heater, the portion of the stay being disposed between the reflection member and the contact portion of the wall, the portion of the stay being disposed between the heater and the contact portion of the wall.

15. The fixing device according to claim 14,
wherein the wall has a recessed shape defining an internal space therein, at least a portion of the stay being disposed inside the internal space of the wall, and
wherein the stay has a recessed shape defining an internal space therein, at least a portion of the reflection member being disposed inside the internal space of the stay.

16. The fixing device according to claim 15,
wherein the stay is elongated along a longitudinal direction of the heater,
wherein the wall is elongated along the longitudinal direction of the heater, the wall having:
a first end in the longitudinal direction of the heater; and
a second end opposite to the first end in the longitudinal direction of the heater, and
wherein the stay has:
a first portion closer to the second end of the wall; and
a second portion protruding from the first portion beyond the first end of the wall in a direction away from the second end of the wall along the longitudinal direction of the heater.

17. The fixing device according to claim 12, wherein the wall comprises liquid crystal polymer.

18. The fixing device according to claim 17, wherein the heater comprises a halogen lamp.

19. The fixing device according to claim 12,
wherein the contact portion has:
a first contact protrusion protruding from the surface toward the stay and contacting the stay;
a second contact protrusion protruding from the surface toward the stay and the contacting the stay, the second contact protrusion being spaced apart from the first contact protrusion in a longitudinal direction of the heater; and
a central contact protrusion protruding from the surface toward the stay and contacting the stay, the central contact protrusion being disposed between the first contact protrusion and the second contact protrusion, and
wherein the surface of the wall has:
a first region disposed between the central contact protrusion and the first contact protrusion, the first region being space apart from the stay; and
a second region disposed between the central contact protrusion and the second contact protrusion, the second region being space apart from the stay.

20. The fixing device according to claim 19,
wherein the wall comprises liquid crystal polymer, and
wherein the heater comprises a halogen lamp.

21. The fixing device according to claim 19, further comprising a reflection member,
wherein the reflection member is recessed in a direction from the reflection member to the stay to define a recess in which at least a portion of the heater is disposed, and
wherein the stay is recessed in a direction from the stay to the wall to define a recess in which at least a portion of the reflection member is disposed.

22. The fixing device according to claim 21,
wherein the stay has:
a first hole; and
a second hole that is an elongated hole, and
wherein the wall further comprises:
a first protrusion having at least a portion disposed inside the first hole of the stay; and
a second protrusion having at least a portion disposed inside the second hole of the stay.

23. The fixing device according to claim 19,
wherein the surface of the wall directly faces the stay.

* * * * *